US012734461B2

(12) United States Patent
Consorti et al.

(10) Patent No.: US 12,734,461 B2
(45) **Date of Patent: *Sep. 15, 2026**

(54) KIT FOR CREATING MINIATURE REPLICA OF A FOOD OR BEVERAGE ITEM

(71) Applicant: MGA Entertainment, Inc., Chatsworth, CA (US)

(72) Inventors: Amandine Consorti, Los Angeles, CA (US); Paula Garcia, Burbank, CA (US); Vera Paras, Lake Balboa, CA (US)

(73) Assignee: MGA Entertainment, Inc., Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/356,996

(22) Filed: Oct. 13, 2025

(65) Prior Publication Data

US 2026/0084072 A1 Mar. 26, 2026

Related U.S. Application Data

(63) Continuation of application No. 19/307,900, filed on Aug. 22, 2025, which is a continuation of application (Continued)

(51) Int. Cl.
*A63H 33/42* (2006.01)
*A63H 33/00* (2006.01)

(52) U.S. Cl.
CPC ..... *A63H 33/42* (2013.01); *A63H 33/001* (2013.01)

(58) Field of Classification Search
CPC ..... A63H 33/001; A63H 33/32; A63H 33/42; A63H 3/005; A63H 3/52; A63H 9/00

(Continued)

(56) References Cited

U.S. PATENT DOCUMENTS 3,598,358 A 8/1971 Clearwaters et al.
3,808,730 A * 5/1974 Cooper ..... A63H 33/3055 446/481

(Continued)

FOREIGN PATENT DOCUMENTS

CN 201904063 U 7/2011
CN 105922582 A 9/2016

(Continued)

OTHER PUBLICATIONS https://www. alibaba.com/product-detail/Whalesale-Price-DIY-Accessory-Silicone-Mold_62485704700. html?spm=a2700.pccps_detail.0.0.640213a0L7hhq3 on Jul. 13, 2023; 13 pgs.

(Continued)

*Primary Examiner* — Joseph B Baldori
(74) *Attorney, Agent, or Firm* — Orbit IP, LLP; Marc G. Martino

(57) ABSTRACT

A miniature replica kit of a food serving includes a shipping container separable into two portions and when the two portions are closed together define an interior volume. The shipping container is configured to contain a plurality of miniature replica items during shipping within the interior volume of the shipping container. The plurality of miniature replica items are associated with the food serving. The plurality of miniature replica items includes at least one non-curable element and at least one curable element. The plurality of miniature replica items include: at least one miniature replica serving container; at least one curable resin contained within a resin container configured to be placed on or within the at least one miniature serving container, wherein the at least one curable resin is a miniature replica food item; and at least one miniature replica ingredient item.

16 Claims, 19 Drawing Sheets

Related U.S. Application Data

No. 18/899,254, filed on Sep. 27, 2024, which is a continuation of application No. 18/647,907, filed on Apr. 26, 2024, now Pat. No. 12,172,100, which is a continuation of application No. 18/510,921, filed on Nov. 16, 2023, now Pat. No. 11,969,667, which is a continuation of application No. 18/461,913, filed on Sep. 6, 2023, now Pat. No. 11,850,533, said application No. 19/307,900 is a continuation of application No. 18/461,896, filed on Sep. 6, 2023, application No. 19/356,996 is a continuation of application No. 18/461,896, filed on Sep. 6, 2023.

(58) Field of Classification Search
USPC ..... 446/491
See application file for complete search history.

(56) References Cited

U.S. PATENT DOCUMENTS

| | | | | |
|---|---|---|---|---|
| 3,966,166 | A | 6/1976 | Elliott | |
| 4,030,235 | A * | 6/1977 | Terzian | A63H 3/52 446/295 |
| 4,593,817 | A * | 6/1986 | Ferrero | B65D 81/365 220/DIG. 13 |
| 4,767,009 | A | 8/1988 | Hornecker et al. | |
| 5,088,598 | A | 2/1992 | Iguchi | |
| 5,306,192 | A | 4/1994 | Caveza et al. | |
| 5,346,423 | A * | 9/1994 | Caveza | A63H 33/3055 426/104 |
| 5,435,518 | A | 7/1995 | Iguchi | |
| 5,480,335 | A * | 1/1996 | Caveza | A63H 33/001 426/104 |
| 5,562,927 | A | 10/1996 | Masuda et al. | |
| 5,632,377 | A * | 5/1997 | Ferrero | B65D 81/365 446/73 |
| 5,727,979 | A | 3/1998 | Spector | |
| 5,728,414 | A * | 3/1998 | Terrasi | A23G 3/566 426/138 |
| 5,858,262 | A | 1/1999 | Lebensfeld | |
| 5,934,969 | A | 8/1999 | Rehkemper et al. | |
| 5,954,561 | A | 9/1999 | Cannone | |
| 5,992,619 | A * | 11/1999 | Milano | B65D 75/32 206/542 |
| 6,135,843 | A | 10/2000 | Merk et al. | |
| 6,503,582 | B1 | 1/2003 | Nardoza et al. | |
| 7,371,144 | B1 | 5/2008 | Begien et al. | |
| 7,744,443 | B2 * | 6/2010 | Cassidy | A63H 33/3055 446/481 |
| 8,152,528 | B2 * | 4/2012 | Alm | G09B 19/00 99/324 |
| 8,343,560 | B2 * | 1/2013 | Blythe | B65D 21/0234 426/106 |
| 8,460,005 | B1 | 6/2013 | Pompey | |
| 8,465,337 | B2 * | 6/2013 | Eisenhut | A63H 33/001 446/87 |
| 9,687,752 | B2 * | 6/2017 | Clark | B44C 3/06 |
| 9,931,579 | B1 * | 4/2018 | Garcia | B65D 25/10 |
| 9,981,197 | B2 * | 5/2018 | Akavia | A63H 33/3055 |
| 10,022,642 | B1 | 7/2018 | Adams | |
| 10,232,278 | B2 | 3/2019 | Suzuki et al. | |
| 11,684,866 | B2 | 6/2023 | Sambati | |
| 11,850,533 | B1 | 12/2023 | Consorti et al. | |
| 11,969,667 | B1 | 4/2024 | Consorti et al. | |
| 11,992,786 | B1 | 5/2024 | Consorti et al. | |
| 12,172,100 | B1 * | 12/2024 | Consorti | A63H 33/42 |
| 2006/0017198 | A1 | 1/2006 | Koehl | |
| 2007/0102308 | A1 * | 5/2007 | Tremblay | B65D 11/04 206/223 |
| 2007/0149092 | A1 | 6/2007 | Begien et al. | |
| 2008/0318489 | A1 | 12/2008 | Eisenhut et al. | |
| 2010/0052222 | A1 | 3/2010 | Kimmel et al. | |
| 2010/0151766 | A1 * | 6/2010 | Hartings | A63H 23/10 446/153 |
| 2013/0122776 | A1 | 5/2013 | Gabai | |
| 2015/0210432 | A1 * | 7/2015 | Lam | B65D 11/188 206/459.5 |
| 2018/0169536 | A1 | 6/2018 | Wells et al. | |
| 2018/0345157 | A1 * | 12/2018 | De Yager | A63H 3/36 |
| 2020/0368633 | A1 | 11/2020 | Johansen et al. | |
| 2021/0170640 | A1 | 6/2021 | Tsai | |
| 2023/0311018 | A1 | 10/2023 | Huang | |
| 2024/0075398 | A1 * | 3/2024 | Ames | A63H 33/001 |
| 2025/0073610 | A1 * | 3/2025 | Consorti | A63H 33/001 |
| 2025/0073611 | A1 * | 3/2025 | Consorti | A63H 33/42 |
| 2025/0387723 | A1 * | 12/2025 | Consorti | A63H 33/42 |
| 2026/0034476 | A1 * | 2/2026 | Consorti | A63H 33/42 |

FOREIGN PATENT DOCUMENTS

| | | | |
|---|---|---|---|
| CN | 111530099 | A | 8/2020 |
| JP | 2010-000152 | A | 1/2010 |
| JP | 2018-164492 | A | 10/2018 |

OTHER PUBLICATIONS https://www.youtube.com/watch?v=3N5AXVXm7tk.
https://www.youtube.com/watch?v=Hrs4LyFmDno.
https://www.youtube.com/watch?v=X2S3RqogGPc.
https://www. youtube.com/watch?v=Y ef82RZ6U cA.
https://www.youtube.com/watch?v=ZjrEDfNEf4.

* cited by examiner

KIT FOR CREATING MINIATURE REPLICA OF A FOOD OR BEVERAGE ITEM

CROSS-REFERENCE TO RELATED APPLICATIONS

This application is a continuation of application Ser. No. 18/461,896 filed on Sep. 6, 2023.

This application is also a continuation of application Ser. No. 19/307,900 filed on Aug. 22, 2025; which is a continuation of application Ser. No. 18/899,254 filed on Sep. 27, 2024; which is a continuation of application Ser. No. 18/647,907 filed Apr. 26, 2024 (now U.S. Pat. No. 12,172,100 issued Dec. 24, 2024); which is a continuation of application Ser. No. 18/510,921 filed Nov. 16, 2023 (now U.S. Pat. No. 11,969,667 issued Apr. 30, 2024); which is a continuation of application Ser. No. 18/461,913 filed Sep. 6, 2023 (now U.S. Pat. No. 11,850,533 issued Dec. 26, 2023).

Application Ser. No. 19/307,900 is also a continuation of application Ser. No. 18/461,896 filed on Sep. 6, 2023.

The entire contents of all the applications described above are fully incorporated herein with these references.

FIELD OF THE INVENTION

The present invention relates to a kit for creating a miniature replica of a food or beverage item.

BACKGROUND OF THE INVENTION

Do-It-Yourself (DIY) toys and collectibles are frequently used to construct models of real-life objects or toys. Many of these toys utilize curable resins in conjunction with a mold that is designed to expel the cured resin to produce the finished toy or component. The resin is therefore designed to be separated from the underlying mold and does not adhere to the underlying mold, limiting designs which may rely on a composite of curable and non-curable solid elements.

Additionally, physical limitations associated with resins and the curing process prevent the creation of certain types of objects. Whether the resin is heat cured or cured via other means, such as ultraviolet light, direct exposure to the curing catalyst is required to set the resin. As a result, molds and molding surfaces are designed in a largely flat shape to enable exposure of the surface area of the resin to heat or light and cure the resin. Additionally, in the case of heat cured resins, an oven or other heating device is required, which can introduce safety risks to users.

There are currently no DIY toys or collectibles that enable construction of sophisticated models of objects that utilize a composite of both cured elements and non-cured elements. Accordingly, improvements are needed in systems and kits for DIY creation of sophisticated models and collectibles in a variety of shapes.

SUMMARY OF THE INVENTION

An exemplary embodiment of the present invention is a kit for creating a miniature replica, the kit comprising: a first base object forming a base of the miniature replica, the first base object comprising a miniature replica of a serving dish; a second base disposed on top of the first base object, the second base object comprising a miniature replica of a food item; a resin container storing a resin configured to be applied to the first and the second base object and to adhere to the first and the second base object, the resin container comprising a miniature replica of a container associated with the food item; one or more ingredient objects configured to be at least partially embedded in the resin, the one or more ingredient objects comprising miniature replicas of one or more ingredients associated with the food item; and wherein the resin is configured to solidify when exposed to ultraviolet light to thereby affix the resin to the first and the second base object and to affix the one or more ingredient objects at least partially within the resin.

The one or more ingredient objects may comprise a miniature replica of a second food item.

One or more second ingredient objects may be included, wherein the one or more second ingredient objects comprise a miniature replica of a utensil.

A packaging container may be included, wherein the first base object, the second base object, the resin container and the one or more ingredient objects are configured to be disposed within the packaging container.

The packaging container may be configured to be separated into two pieces to remove the first base object, the second base object, the resin container and the one or more ingredient objects disposed within.

At least one piece of the two pieces of the packaging container may comprise a semi-spherical ball.

Another exemplary embodiment of the present invention is a kit for creating a miniature replica, the kit comprising: a first base object forming a base of the miniature replica, the first base object comprising a miniature replica of a bowl; a second base object disposed within the second base object, the second base object comprising a miniature replica of a food item; a resin container storing a resin configured to be applied to the second base object disposed within the first base object and to adhere to the first and the second base object, the resin container comprising a miniature replica of a container associated with the food item; one or more ingredient objects configured to be at least partially embedded in the resin, the one or more ingredient objects comprising miniature replicas of one or more ingredients associated with the food item; and wherein the resin is configured to solidify when exposed to ultraviolet light to thereby affix the resin to the first and the second base object and to affix the one or more ingredient objects at least partially within the resin.

The one or more ingredient objects may comprise a miniature replica of a second food item.

One or more second ingredient objects may be included, wherein the one or more second ingredient objects comprise a miniature replica of a utensil.

A packaging container may be included, wherein the first base object, the second base object, the resin container and the one or more ingredient objects are configured to be disposed within the packaging container.

The packaging container may be configured to be separated into two pieces to remove the first base object, the second base object, the resin container and the one or more ingredient objects disposed within.

At least one piece of the two pieces of the packaging container comprise a semi-spherical ball.

The bowl may have a height of between 15-20 mm.

The bowl may have a height between 25-30 mm and a width between 25-30 mm.

Another exemplary embodiment of the present invention is a kit for creating a miniature replica of a model object, the kit comprising: a base object that forms a base of the miniature replica, the base object comprising a miniature replica of a component of the model object; a resin container storing a resin configured to be applied to the base object and to adhere to the base object, the resin container comprising a miniature replica of a container associated with the model object; one or more ingredient objects configured to be at least partially embedded in the resin, the one or more ingredient objects comprising miniature replicas of one or more ingredients associated with the model object; wherein the resin is configured to solidify when exposed to ultraviolet light to thereby affix the resin to the base object and to affix the one or more ingredient objects at least partially within the resin; and a packaging container, wherein the base object, the resin container and the one or more ingredient objects are configured to be disposed within the packaging container; wherein the packaging container is configured to be separated into two pieces to remove the base object, the resin container and the one or more ingredient objects disposed within the packaging container.

At least one piece of the two pieces of the packaging container may comprise a semi-spherical ball.

A second base object may be disposed within the packaging container, the second base object comprising a miniature replica of a food item.

The one or more ingredient objects may comprise a miniature replica of a second food item.

One or more second ingredient objects may be included, wherein the one or more second ingredient objects comprise a miniature replica of a utensil.

The base object may comprise a miniature replica of a serving dish or a bowl.

Other features and advantages of the present invention will become apparent from the following more detailed description, when taken in conjunction with the accompanying drawings, which illustrate, by way of example, the principles of the invention.

DETAILED DESCRIPTION OF EMBODIMENTS OF THE INVENTION

While methods, compositions, and products are described herein by way of examples and embodiments, those skilled in the art recognize that the described methods, compositions, and products for creating a miniature replica of a food or beverage item are not limited to the embodiments or drawings described. It is understood that the drawings and description are not intended to be limited to the particular form disclosed. Rather, the intention is to cover all modifications, equivalents, and alternatives falling within the spirit and scope of the appended claims. Any headings used herein are for organizational purposes only and are not meant to limit the scope of the description or the claims. As used herein, the word "can" is used in a permissive sense (i.e., meaning having the potential to) rather than the mandatory sense (i.e., meaning must). Similarly, the words "include," "including," and "includes" mean including, but not limited to.

Figure 1:
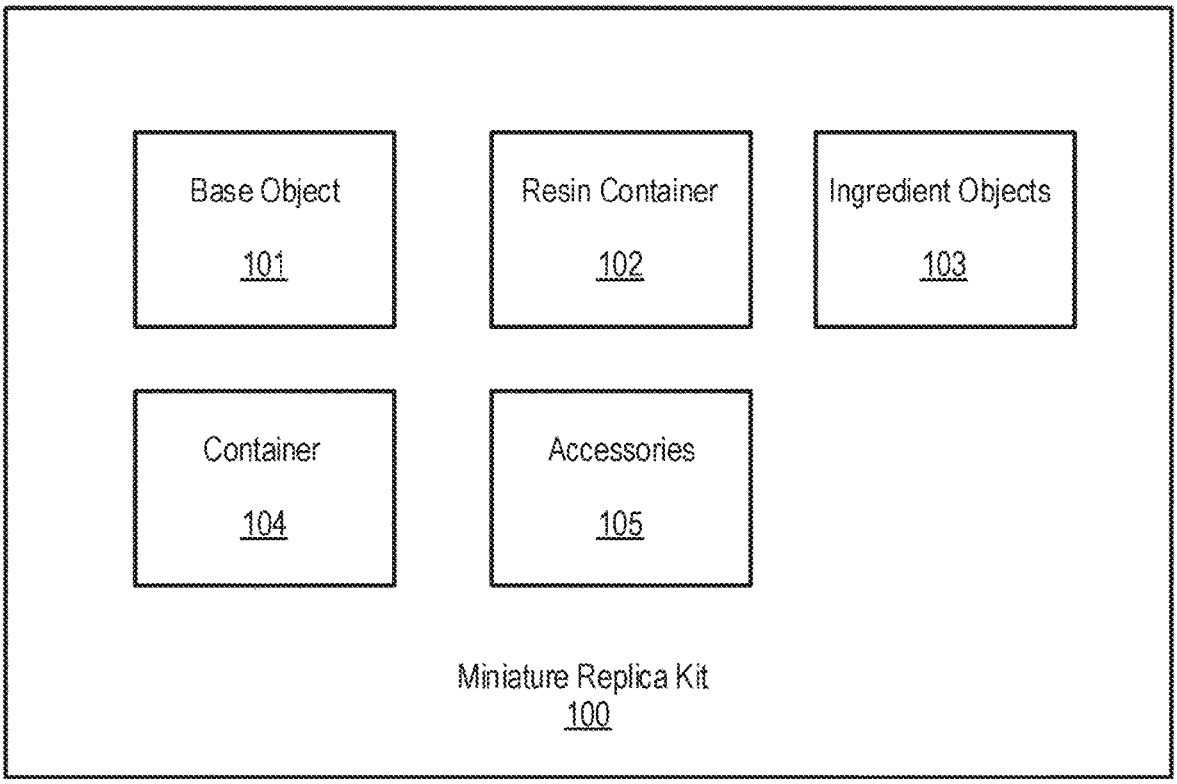
FIG. 1 illustrates the components of a miniature replica kit according to an exemplary embodiment.

FIG. 1 illustrates the components of a miniature replica kit 100 according to an exemplary embodiment. The miniature replica kit is a product that can be used to create a miniature replica of an object. The present description relates to a kit used to create a miniature replica of a food or beverage item, but it is understood that the miniature replica kit can be used to create models/replicas of other categories of models as well. For example, the miniature replica kit can be used to create replicas of objects such as plants, rooms, geographic formations, scenery, structures, buildings, etc.

The miniature replica kit 100 includes at least one base object 101 that forms a base of the miniature replica of the food or beverage item, the at least one base object comprising a miniature replica of a component of the food or beverage item. As discussed in greater detail below, the base object forms a part of the miniature replica of the food or beverage item and is configured to receive the resin, which is applied to the at least one base object. Unlike previous DIY systems that use a mold designed to expel cured resin, the base object of the present system is configured to adhere to the resin and bond with the resin when the resin is cured.

Figure 2:
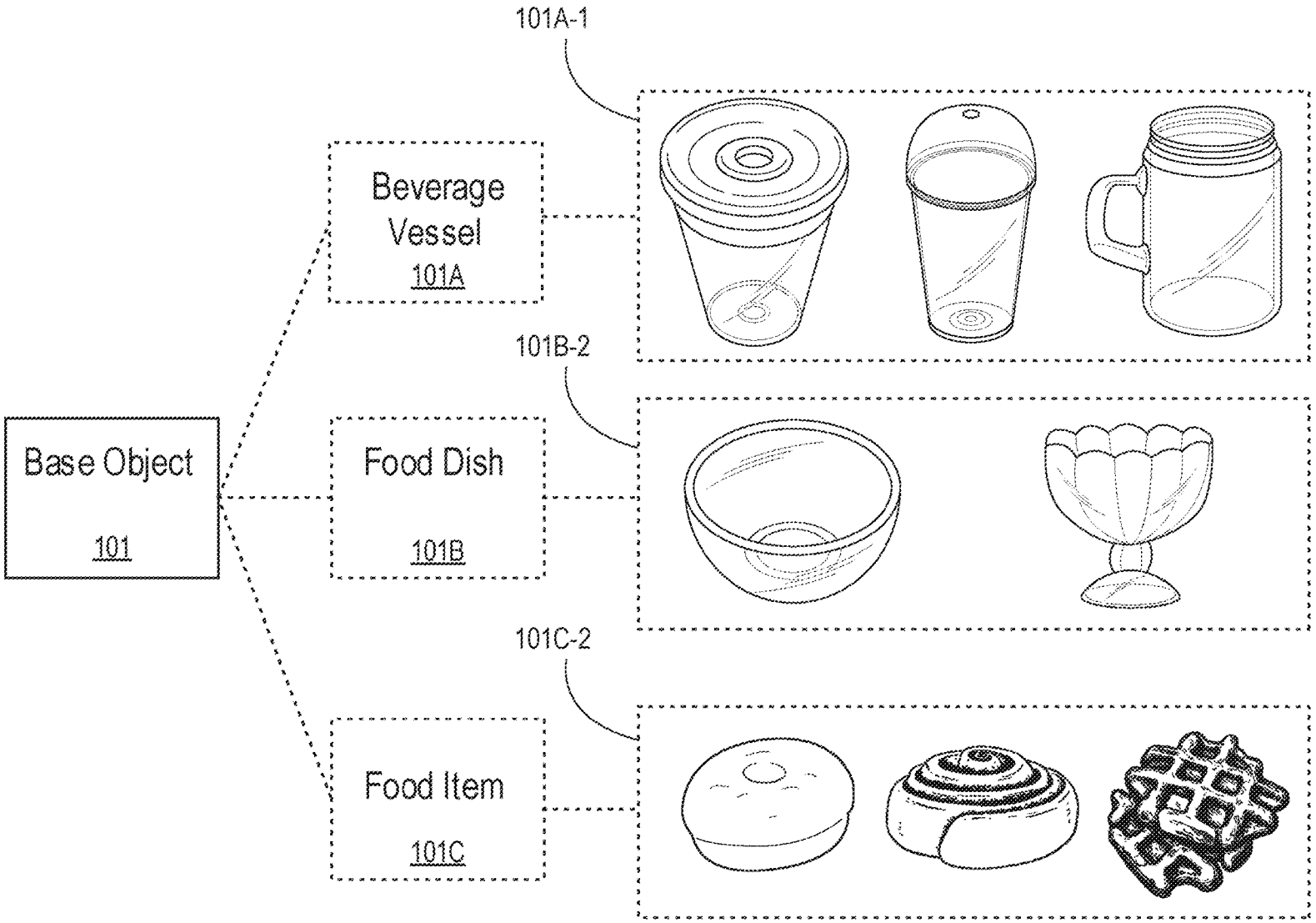
FIG. 2 illustrates different types of base objects according to an exemplary embodiment.

FIG. 2 illustrates different types of base objects 101 according to an exemplary embodiment. The base object can be a beverage vessel 101A. For example, as shown in box 101A-1, the base object can be a cold drink vessel and lid, a boba/bubble tea vessel and lid, or a mason jar with a handle. These examples are provided for illustration only and it is understood that base objects can comprise miniature replicas of other types of beverage vessels, such as cups, coffee cups, mugs, wine glasses, mason jars, mason jars with handles, milkshake glasses, slushy cups, and/or tumblers. In an exemplary embodiment, the beverage vessel can be between 35 mm (millimeters) and 45 mm in length. For example, the cold drink vessel can be between 35-40 mm in length and the boba cup and lid can be between 40-45 mm in length. The beverage vessel can have a width between 20-35 mm, depending on the type of vessel.

The base object can also be a food dish 101B. For example, as shown in box 101B-2, the base object can be a bowl, such as a cereal bowl or a fruit bowl. The base object can of course comprise miniature replicas of other types of dishware, cookware or serving platters, such as plates, pots, bakeware, bakery trays, cake stands, sherbet cups, and/or pie pans. In an exemplary embodiment, the dish is a cereal bowl having a height of between 15-20 mm. In another exemplary embodiment, the dish is a fruit bowl having a height between 25-30 mm and a width between 25-30 mm.

The base object can also be a food item 101C. Box 101C-2 illustrates examples of base objects that correspond to a food item, such as a donut, a cinnamon roll, or a waffle. The base objects can be other food items, such as ice cream, French toast, toast, cakes, pies, pie crust, cheesecake, pancakes, or other food items.

The kit can also include multiple base objects. For example, the kit can include base objects of pancakes and a plate. In this case, the resin (in the form of syrup) and assorted toppings can be applied to both the pancakes and the plate to create the completed dish.

Returning to FIG. 1, the miniature replica kit also includes a resin container. The resin container stores a resin configured to be applied to the base object and to adhere to the base object. The resin can be applied to the base object in different ways. For example, when the base object is a vessel such as a bowl or a cup, the resin can be applied within the interior of the vessel, such that the vessel holds the resin. In another example, when the base object is a food object, such as a donut, waffle, or pastry, the resin can be applied to the top of the base object as a glaze or topping.

Unlike existing DIY systems that use a mold which is designed to expel the cured resin, the resin of the present system is configured to adhere to the base object and to bond with the base object when the resin is cured.

The resin can be an ultraviolet light cured resin that is configured to solidify when exposed to ultraviolet light to thereby affix the resin to the base object. The resin can be configured to cure/activate when exposed to ambient ultraviolet light, such as sunlight or daylight, such that the user can cure the resin simply by placing the completed food and beverage item in sunlight (e.g., on a windowsill or outdoors). As will be discussed in greater detail below, the resin can also be configured to affix one or more ingredient objects at least partially within the resin.

Figure 3:
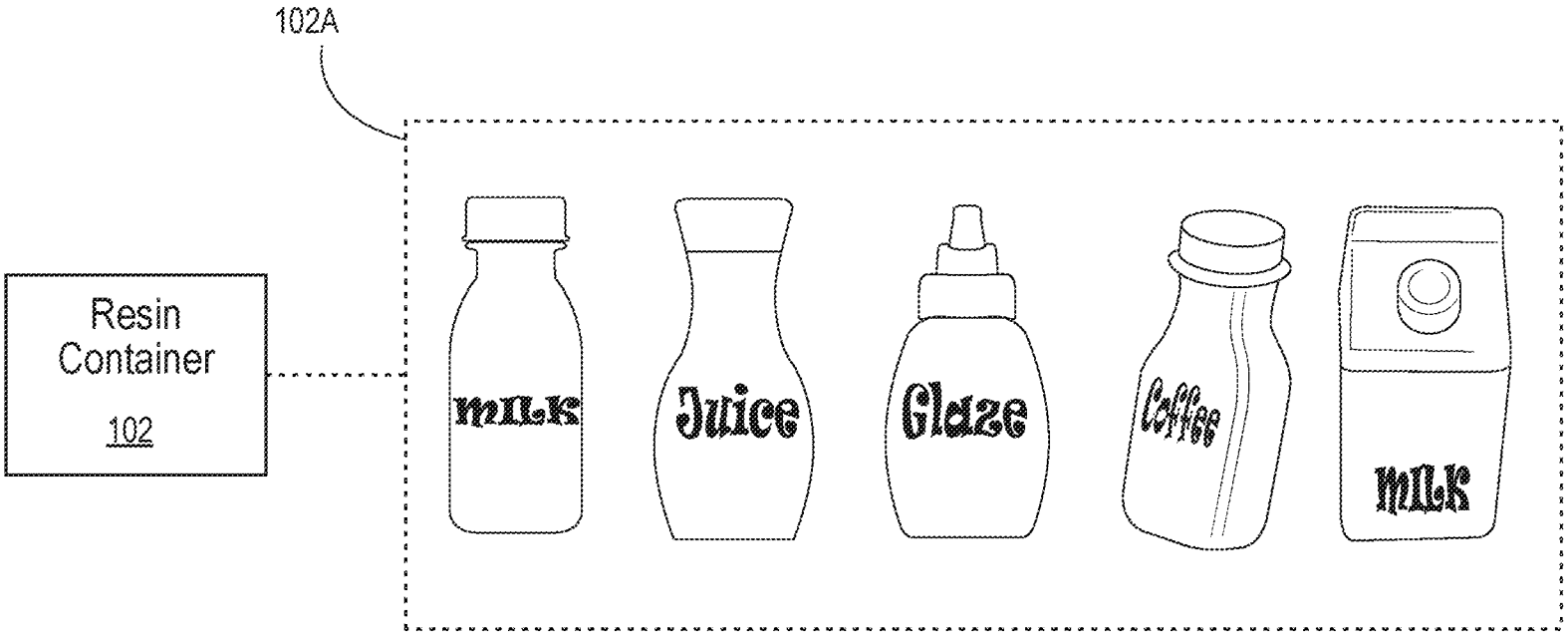
FIG. 3 illustrates examples of different resin containers according to an exemplary embodiment.

FIG. 3 illustrates examples of different resin containers according to an exemplary embodiment. As shown in box 102A, the resin containers can be modeled to look like miniature replicas of a milk tea bottle, a juice bottle, a bottle of glaze, a bottle of coffee, or a carton of milk. Of course, the resin containers can be miniature replicas of other types of containers, such as a maple syrup bottle, a chocolate syrup bottle, a frosting container, a liquor bottle, a soda bottle, or other types of bottles.

The resin container can be a miniature replica of a container associated with the food or beverage item that is created with the kit. For example, the resin container can be a miniature replica of a container of an ingredient used to create the food or beverage item. Using the examples shown in FIG. 3, the resin container can be: a milk tea bottle, with milk tea being an ingredient used to make boba/bubble tea; a juice bottle, with juice being an ingredient used to make a berry punch or lemonade; a glaze/syrup bottle, with glaze or syrup being an ingredient used to make donuts, pastries, or cake; a coffee bottle, with coffee being an ingredient used to make coffee drinks such as lattes or cappuccinos; or a milk bottle, with milk being an ingredient in many foods and beverages, such as cereal. The resin container can also be a miniature replica of a peanut butter bottle, a cream bottle, a jam/jelly container, etc.

Referring to FIG. 1, the miniature replica kit 100 also includes ingredient objects. The ingredient objects are configured to be at least partially embedded in the resin, the one or more ingredient objects comprising miniature replicas of one or more ingredients associated with the food or beverage item. The ingredient objects can be completely embedded in the resin, as in the case of replica ice cubes in a drink, or partially embedded in the resin, as in the case of sprinkles on glaze.

Figure 4:
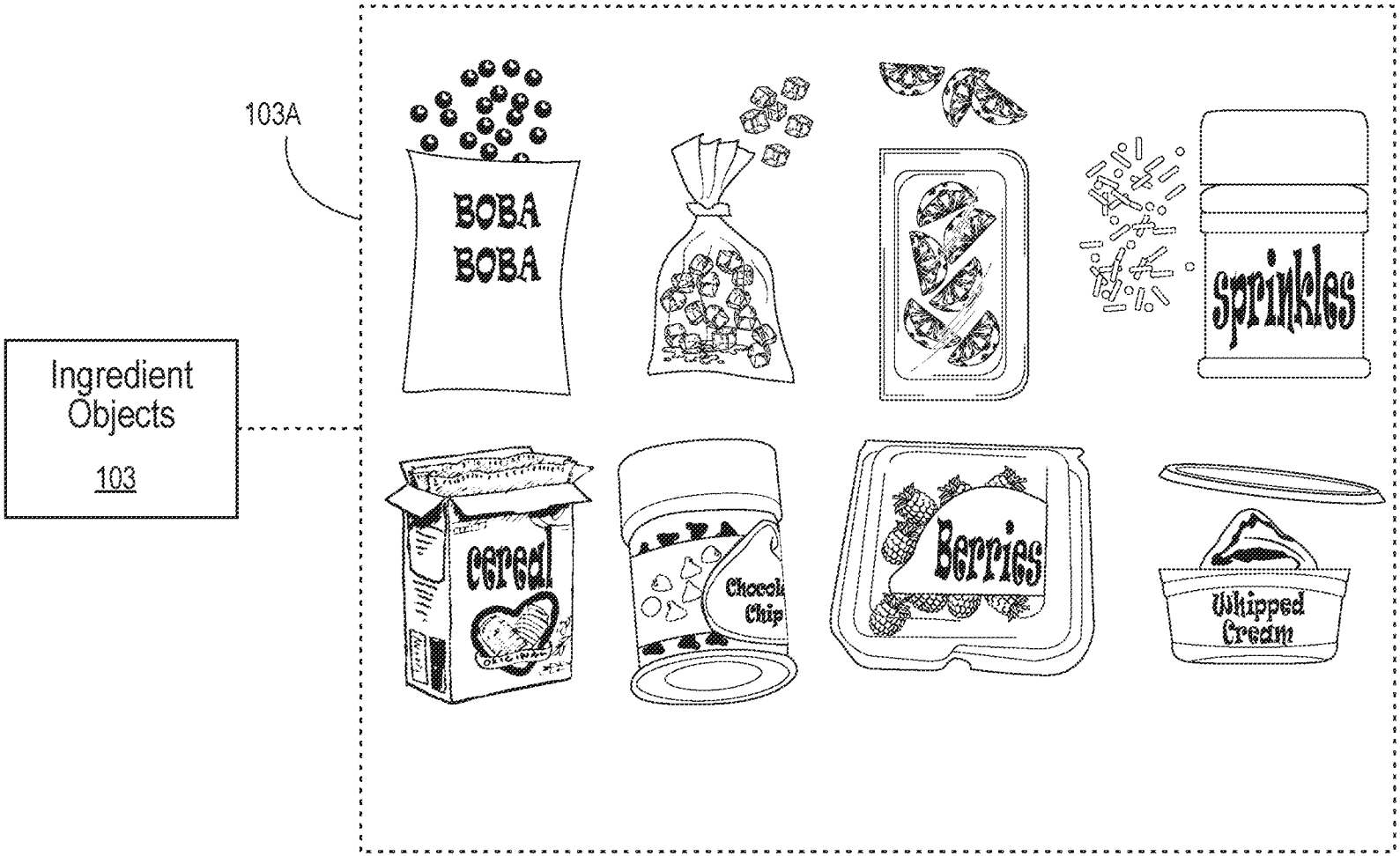
FIG. 4 illustrates examples of different ingredient objects according to an exemplary embodiment.

FIG. 4 illustrates examples of different ingredient objects according to an exemplary embodiment. As shown in box 103A, the ingredients can be modeled to look like miniature replicas of tapioca bubbles (in boba/bubble tea), ice cubes, limes, sprinkles, cereal, chocolate chips, raspberries, and/or whipped cream. Of course, the ingredient objects can be miniature replicas of other types of ingredients, such as toppings (such as candies or chocolates), other types of fruit (strawberries, bananas, etc.), vegetables, garnishes, pasta, macaroni, rice, risotto, or any other type of ingredient used in foods and beverages.

As explained above, the ingredient objects can be miniature replicas of ingredients associated with the food or beverage item that is created with the kit. For example, the ingredients can be miniature replicas of ingredients used to create the food or beverage item. Using the examples shown in FIG. 4, the ingredient objects can be replicas of: tapioca bubbles, with tapioca bubbles being an ingredient used to make the food/beverage item of boba/bubble tea. In an exemplary embodiment, the tapioca bubbles can have a diameter of between 3-5 mm; ice cubes, with ice cubes being an ingredient used to make the food/beverage item of iced drinks, such as boba, lemonade, fruit punch, etc.; limes, with limes being an ingredient used to make the food/beverage item of limeade, cocktails, etc.; sprinkles, with sprinkles being an ingredient used to make the food/beverage items of cupcakes, donuts, cakes, ice cream, etc.; cereal, with cereal being an ingredient used to make the food/beverage item of a bowl of cereal; chocolate chips, with chocolate chips being an ingredient used to make the food/beverage item of donuts, pastries, cake, cupcakes, muffins, etc.; berries, with berries being an ingredient used to make the food/beverage item of berry punch, fruit salad, etc.; and/or whipped cream, with whipped cream being an ingredient used to make the food/beverage item of hot chocolate, a latte, a mocha, an ice cream sundae, etc.

As discussed earlier, the resin is configured to solidify when exposed to ultraviolet light to thereby affix the resin to the base object and to affix the one or more ingredient objects at least partially within the resin. The ingredients described above can be at least partially embedded in the resin and affixed within the resin when the resin is cured. Ingredient objects can additionally include replicas of lime slices, lemon slides, pineapple rings, chocolate chips, sprinkles, blueberries, orange slices, strawberries, chocolate bars, banana slices, marshmallows, avocado slices, cherries, blackberries, etc.

Returning to FIG. 1, the miniature replica kit 100 can include a container 104 that houses the base object 101, the resin container 102, the one or more ingredient objects 103, and any accessories 105. The container is configured to house the components while maintaining as small a footprint as volumetrically possible. Additionally, at least a portion of the container is reconfigurable to serve as a display device for the miniature replica of the food or beverage item created with the kit.

Figure 5A:
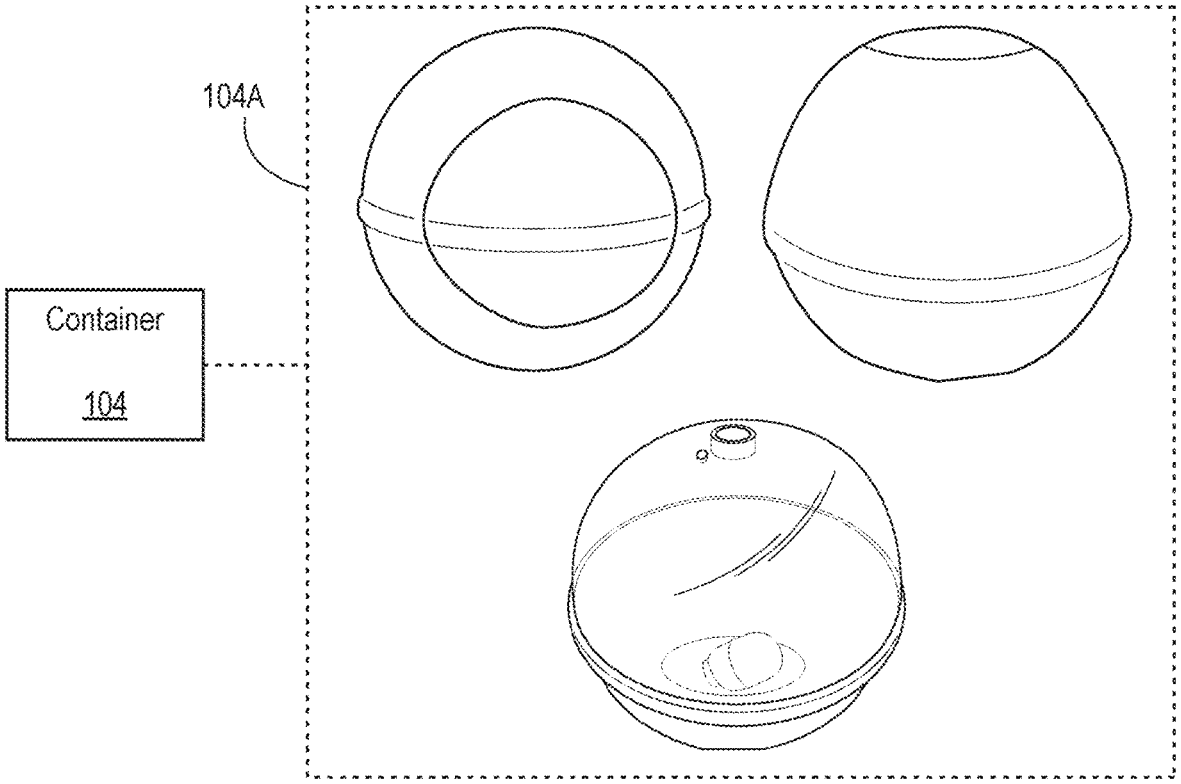
FIGS. 5A-5B illustrate a container according to an exemplary embodiment.
Figure 5B:
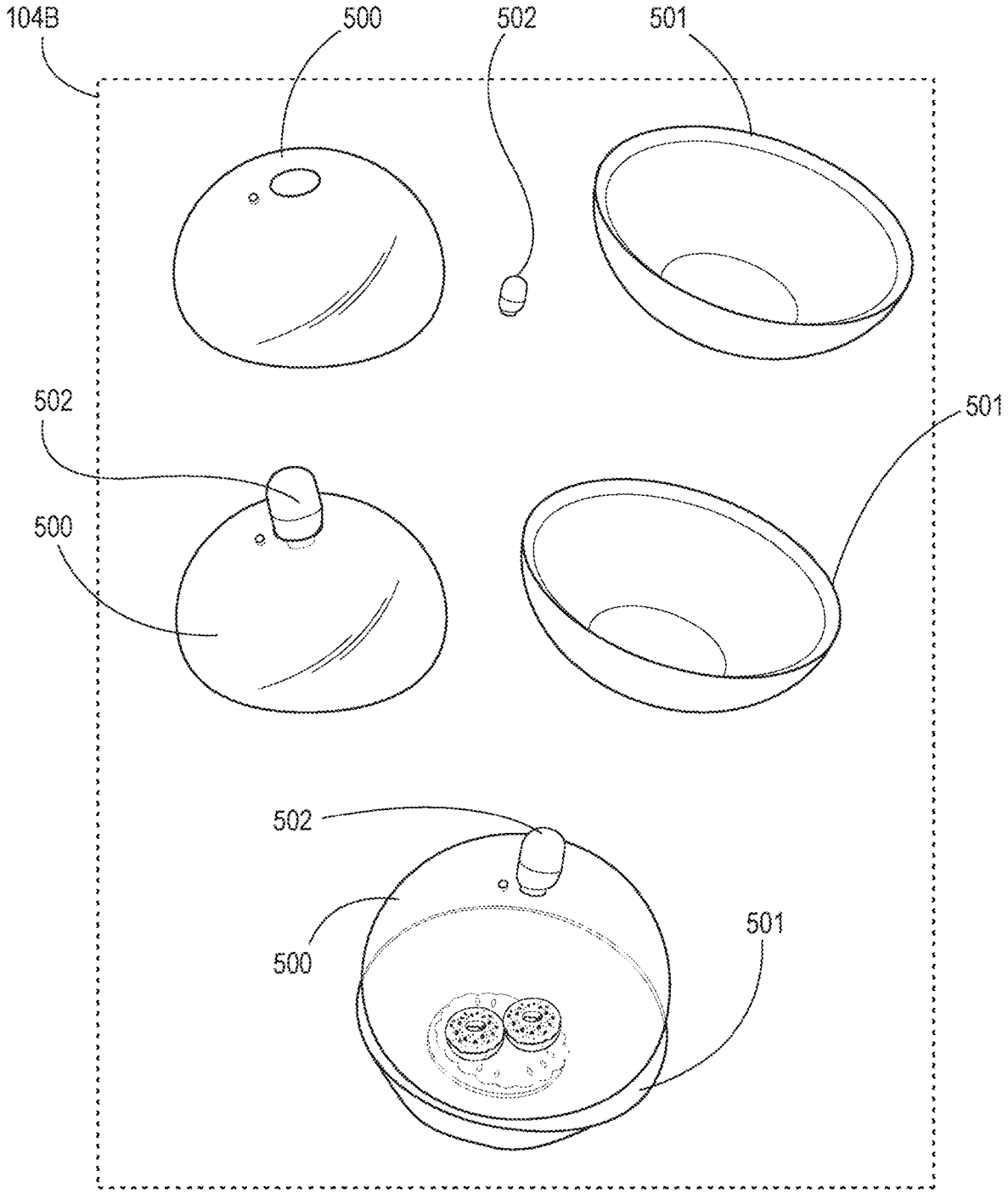

FIGS. 5A-5B illustrate a container according to an exemplary embodiment. As shown in box 104A of FIG. 5A, the container can be contained in one or more layers of packaging. As shown in the figure with the packaging is removed, the container can be a semi-spherical ball, having a flat bottom and a clear top in a dome shape. The container can be separated into two pieces to remove the other parts of the kit (e.g., the base object, resin container, ingredient objects, and accessories) contained within the container.

FIG. 5B illustrates the reconfiguration of the container into a display device for the food or beverage item according to an exemplary embodiment. As shown in box 104B, the container can be separated into two parts, a transparent top dome 500 and bottom portion 501. The bottom portion 501 of the container can serve as a platter. Additionally, the container can store a handle component 502 that is designed to be inserted into the top dome 500 to allow the top dome to function as the lid for a platter. The top-most drawing in box 104B illustrates the container separated into the top dome 500 and bottom portion 501, along with the handle component 502. The center drawing in box 104B illustrates the handle component 502 inserted into the top dome 500. The bottom drawing in box 104B illustrates the container reconfigured into a display platter, with the bottom portion 501 acting as the bottom of the platter and the top dome 500 and handle component 502 acting as the lid of the display platter. As shown in the bottom drawing, a food and beverage item is displayed under the transparent dome 500 of the platter.

Returning to FIG. 1, the miniature replica kit can additionally include one or more accessories. The accessories can be objects that are at least partially embedded in the resin. The accessories can also be objects that form part of a display of the food or beverage item, such as serving or display platters or placemats. Additionally, the accessories can be miniature replicas of dishes or utensils associated with the food or beverage item, such as spoons, forks, serving spoons, and straws. The accessories can also be tools used to manipulate parts of the kit, such as the ingredient objects, that resemble utensils, such as tongs that are used to pick up ingredients such as replicas of ice cubes, replicas of pieces of fruit, or replicas of tapioca bubbles. In an exemplary embodiment, the tongs can have width (at the widest part) of between 7-8 mm and a length of between 45-55 mm.

Figure 6:
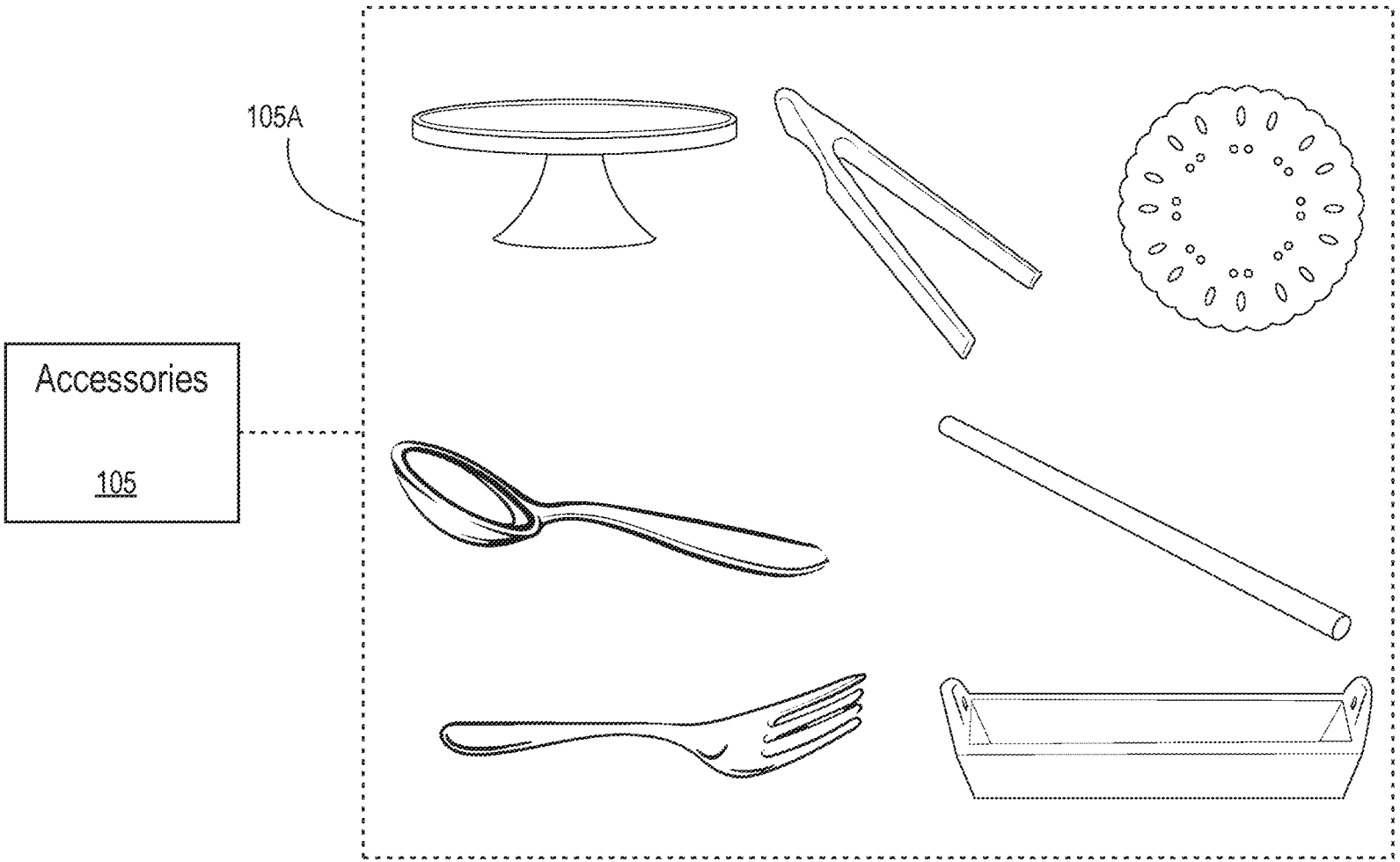
FIG. 6 illustrates examples of different accessories according to an exemplary embodiment.

FIG. 6 illustrates examples of different accessories according to an exemplary embodiment. Examples of accessories 105 are shown in box 105A. As shown in the figure, accessories can include a serving platter, tongs, a placemat, a spoon, a straw, a fork, and/or serving tray. In an exemplary embodiment, the boba straw can have a diameter between 4-6 mm and non-boba straw can have a diameter between 1-3 mm. Additional accessories can include miniature dollies, tables, coasters, garnish, serving spoons, etc.

While each kit for creating a miniature replica of a food or beverage item is unique, each kit is constructed from components that are consistent with and relate to the miniature replica of the food and beverage item. Additionally, the components of the kit have complementary properties to ensure that the miniature replica of the food and beverage item can be constructed and cured.

The base object and resin comprise complementary properties that enable the resin to remain adhered to the base object prior to exposure to the ultraviolet light and enable the ultraviolet light to penetrate the resin to thereby allow for curing of the resin in its applied form.

Figure 7:
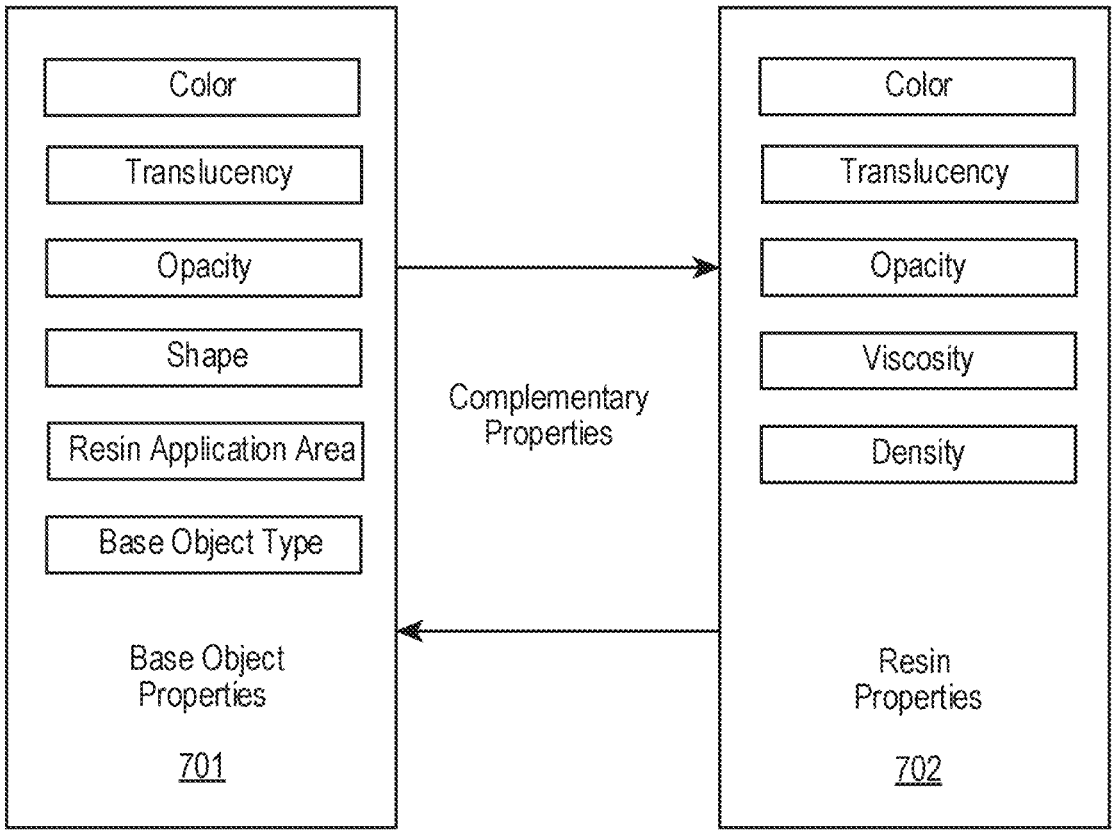
FIG. 7 illustrates the properties of base objects and the resin that can form complementary properties according to an exemplary embodiment.

FIG. 7 illustrates the properties of base objects and the resin that can form complementary properties according to an exemplary embodiment. The base object properties 701 can include color, translucency, opacity, shape, resin application area, and base object type. The resin application area property refers to a location on or in the base object that the resin is intended to be applied. For example, the resin application area can be on the surface of the base object, such as for a replica of donut, or within the object, such as for a replica glass or drink vessel. Additionally, the base object type property refers to a type of base object, such as the types shown in FIG. 2 (beverage vessel, food dish, food item, etc.). The resin properties 702 can include color, translucency, opacity, viscosity, and density. As shown in FIG. 7, the base object properties 701 and the resin properties can be complementary to enable the resin to remain adhered to the base object prior to exposure to the ultraviolet light and enable the ultraviolet light to penetrate the resin.

Figure 8:
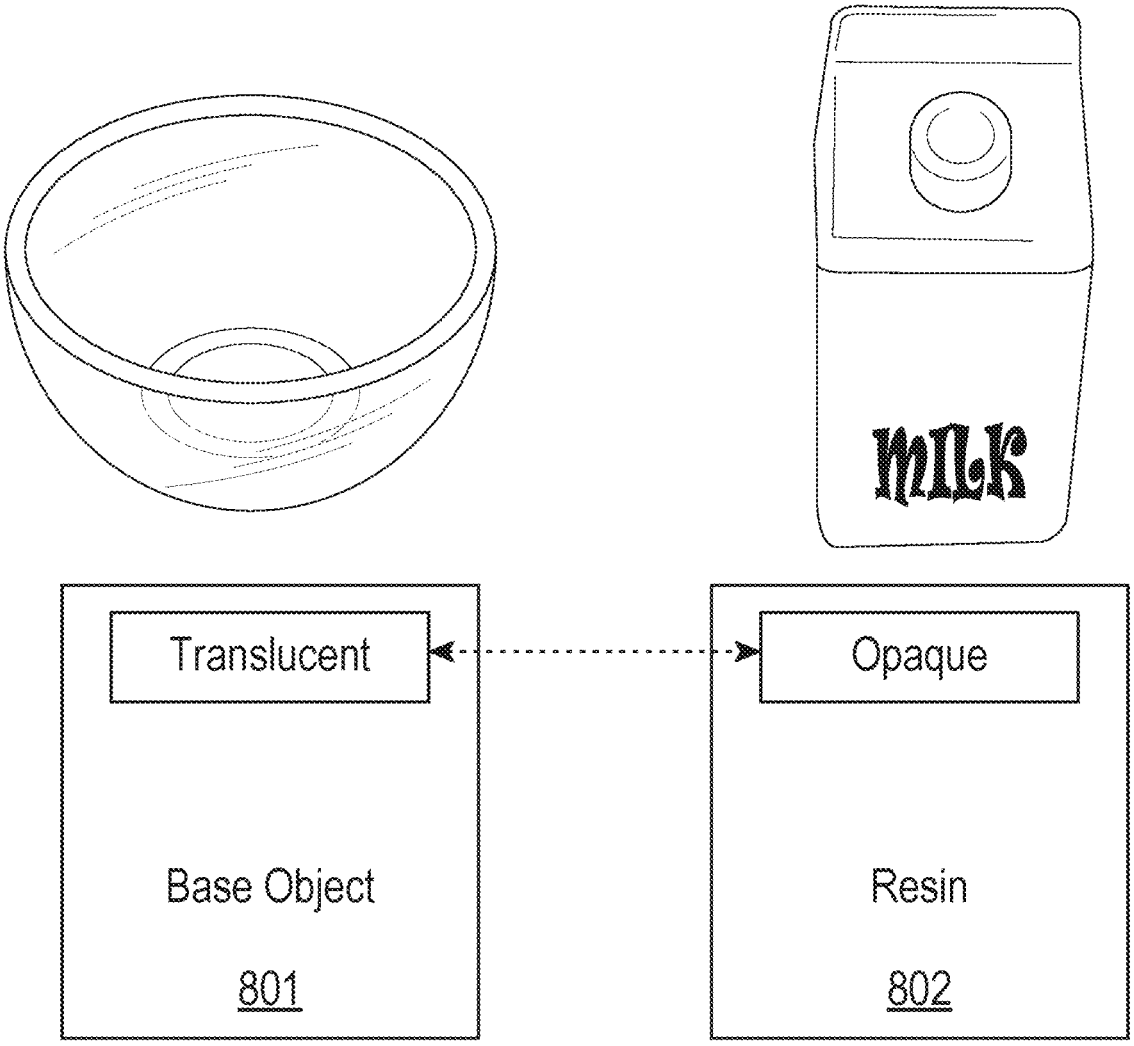
FIG. 8 illustrates an example of complementary base object and resin properties according to an exemplary embodiment.

FIG. 8 illustrates an example of complementary base object and resin properties according to an exemplary embodiment. As shown in FIG. 8, the resin 802 is designed to take on the appearance of milk (e.g., for a cereal food item) and is therefore opaque. However, due to the ultraviolet light curing process, it is necessary to ensure that adequate ultraviolet light penetrates the resin to enable curing of the resin. However, since the resin itself is opaque and applied within the base object (e.g., the "milk" is poured into the "cereal bowl"), it is necessary to make the base object (the cereal bowl) translucent, to ensure that the ultraviolet light passes through the base object and penetrates the resin.

Figure 9:
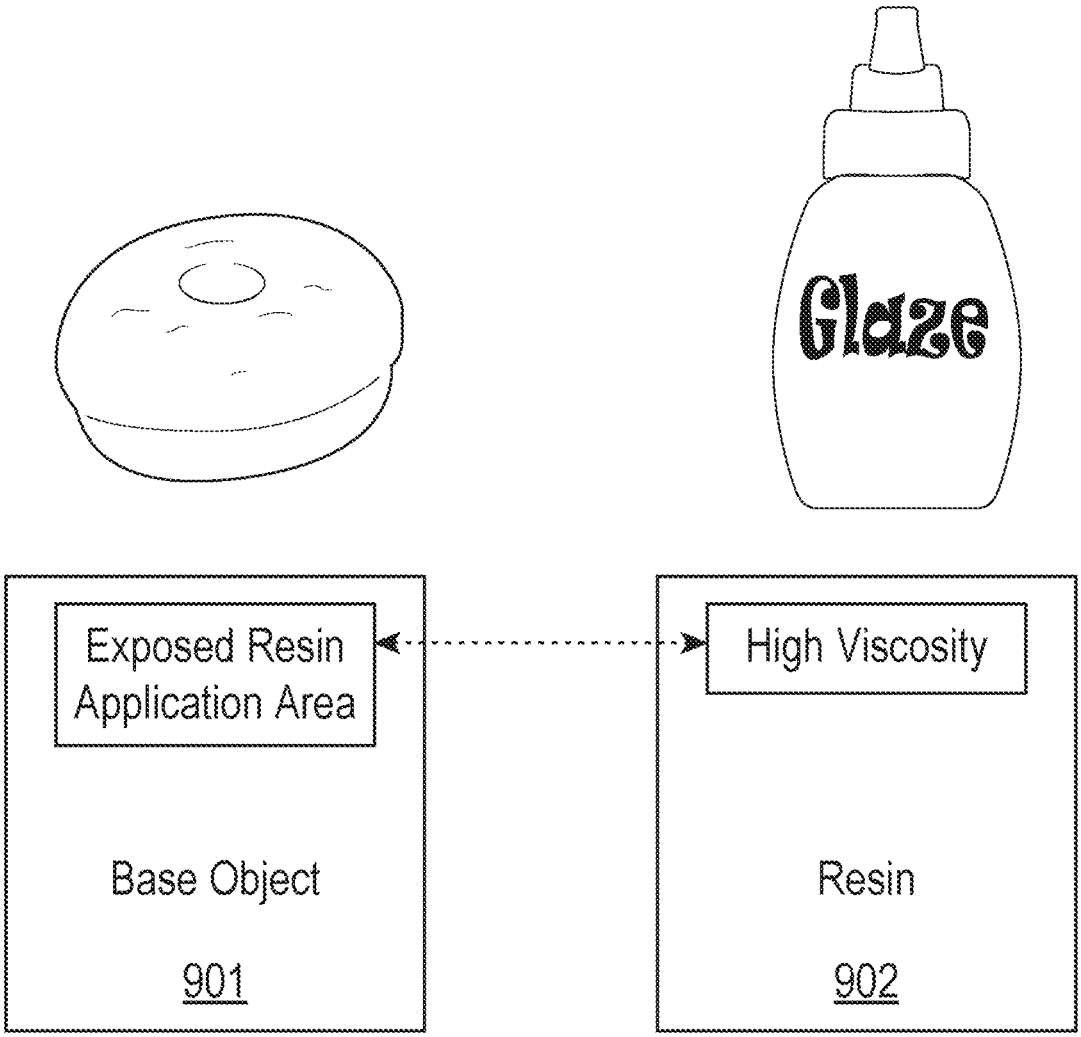
FIG. 9 illustrates another example of complementary base object and resin properties according to an exemplary embodiment.

FIG. 9 illustrates another example of complementary base object and resin properties according to an exemplary embodiment. In the example of FIG. 9, the base object 901 is a donut and the resin application area property of the base object is an exposed resin application area of the donut. Because the resin application area is an area that is not contained within the base object (such as the interior of a vessel) but rather an area on the surface of the base object, the resin 902 can have a complementary property of high viscosity, to ensure that the resin does not run off the surface of the base object when the resin is applied to the base object.

Figure 10:
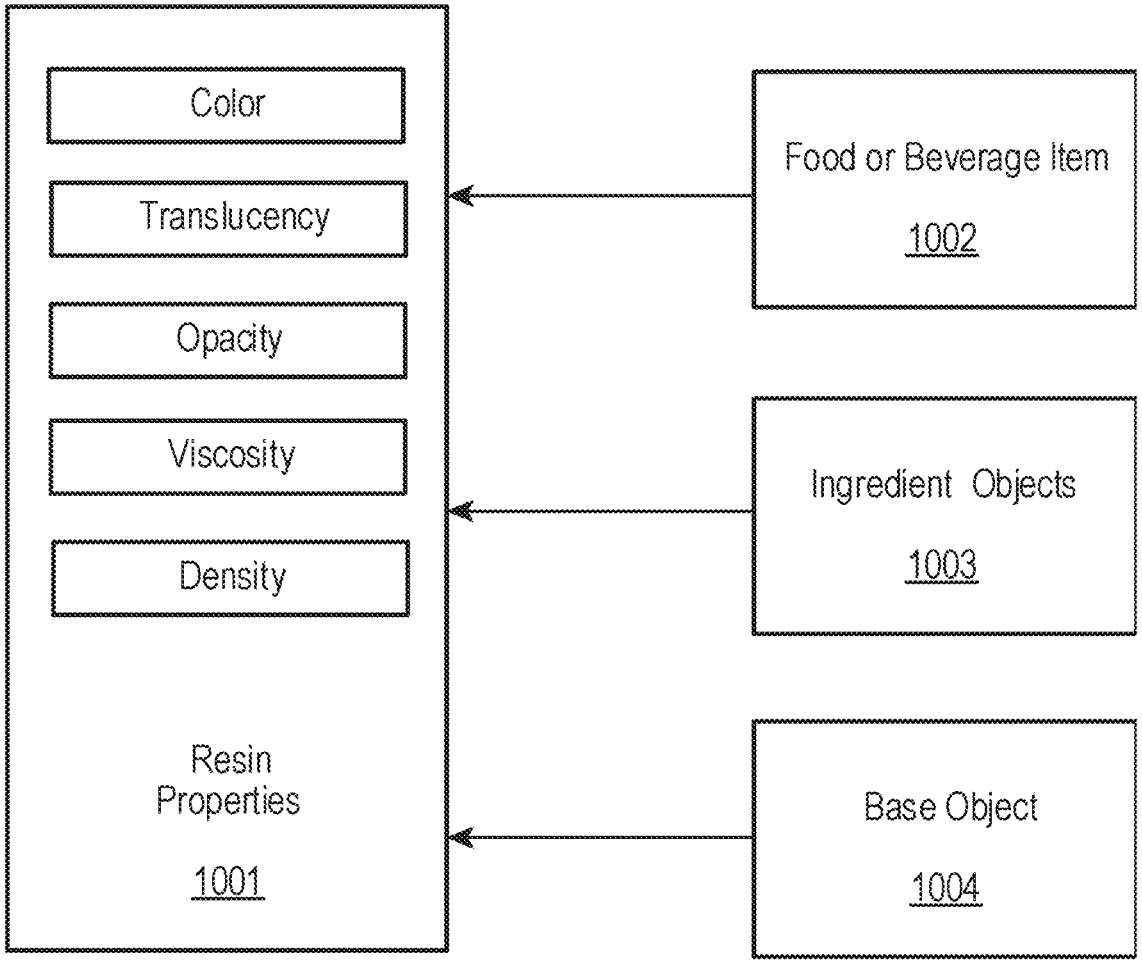
FIG. 10 illustrates the resin properties that can be customized according to an exemplary embodiment.

In addition to the base object and resin having complementary properties, the properties of the resin can be customized based on other factors. FIG. 10 illustrates the resin properties that can be customized according to an exemplary embodiment. As shown in FIG. The resin properties 1001 can be customized based on the food or beverage item 1002 configured to be created by the kit, the corresponding ingredient objects 1003 in the kit, and/or the corresponding base object 1004 in the kit. The resin properties that can be customized include color, translucency, opacity, viscosity, and/or density.

Figure 11:
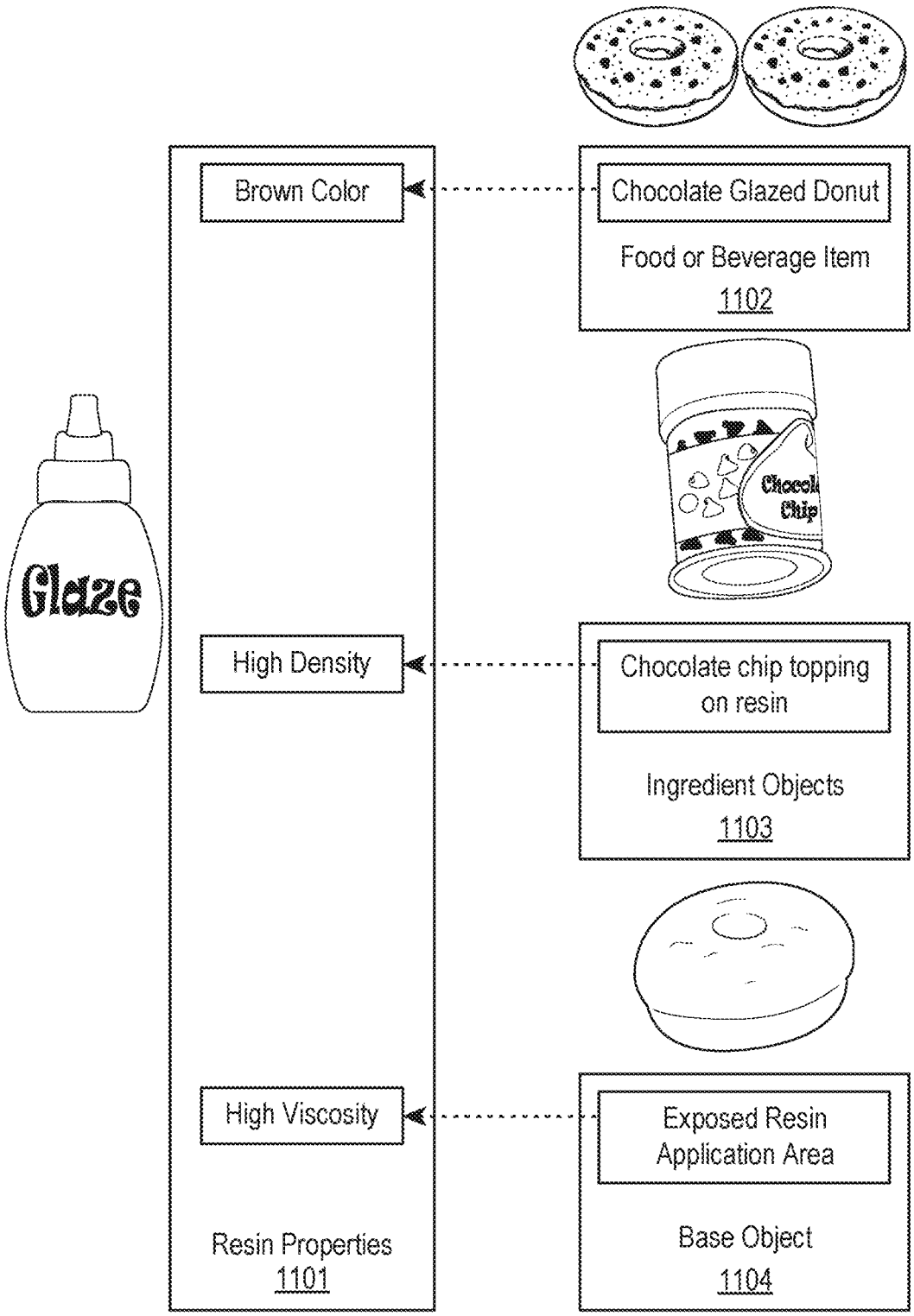
FIG. 11 illustrates an example of resin properties customized to a corresponding food or beverage item created by a kit, corresponding ingredient objects, and the corresponding base object according to an exemplary embodiment.

FIG. 11 illustrates an example of resin properties customized to a corresponding food or beverage item created by a kit, corresponding ingredient objects, and the corresponding base object according to an exemplary embodiment. As shown in FIG. 11, the resin properties 1101 include a brown color, high density, and high viscosity.

The brown color property can be the result of the food or beverage item 1102 being a chocolate glazed donut. In this case, the color of the resin can be selected to match the color of a chocolate glaze. Similarly, a white opaque color resin can be used for milk in a cereal bowl object, a red transparent color can be used for a berry punch, a green transparent color can be used for limeade, and/or an opaque light brown color resin can be used for a latte or coffee-based drink object.

The high-density property can be the result of the ingredient 1103 being a chocolate chip topping designed to sit on top of the resin. Since the chocolate chip replicas are designed to sit on top of the resin, it is important that the resin have sufficient density to ensure that the chocolate chips do not pass through the resin. In certain miniature replica kits, the resin can be configured to have a low density. For example, for boba, lemonade, or other drinks with ingredients such as ice cubes, the resin should have a lower density to ensure that the ingredients do not rest on the surface of the resin and instead sink into the resin.

The high viscosity property can be the result of the base object 1104 being a donut with an exposed resin application area. In this case, since the resin is applied to the surface of the base object, it is important to have sufficient viscosity such that the resin does not run off the edges of the donut prior to being cured. Miniature replica kits for other types of objects can utilize low viscosity resins. For example, foods and beverages that utilize vessels can use low viscosity resins, since the vessel can contain the resin from running out of and down the sides of the vessel.

Figure 12:
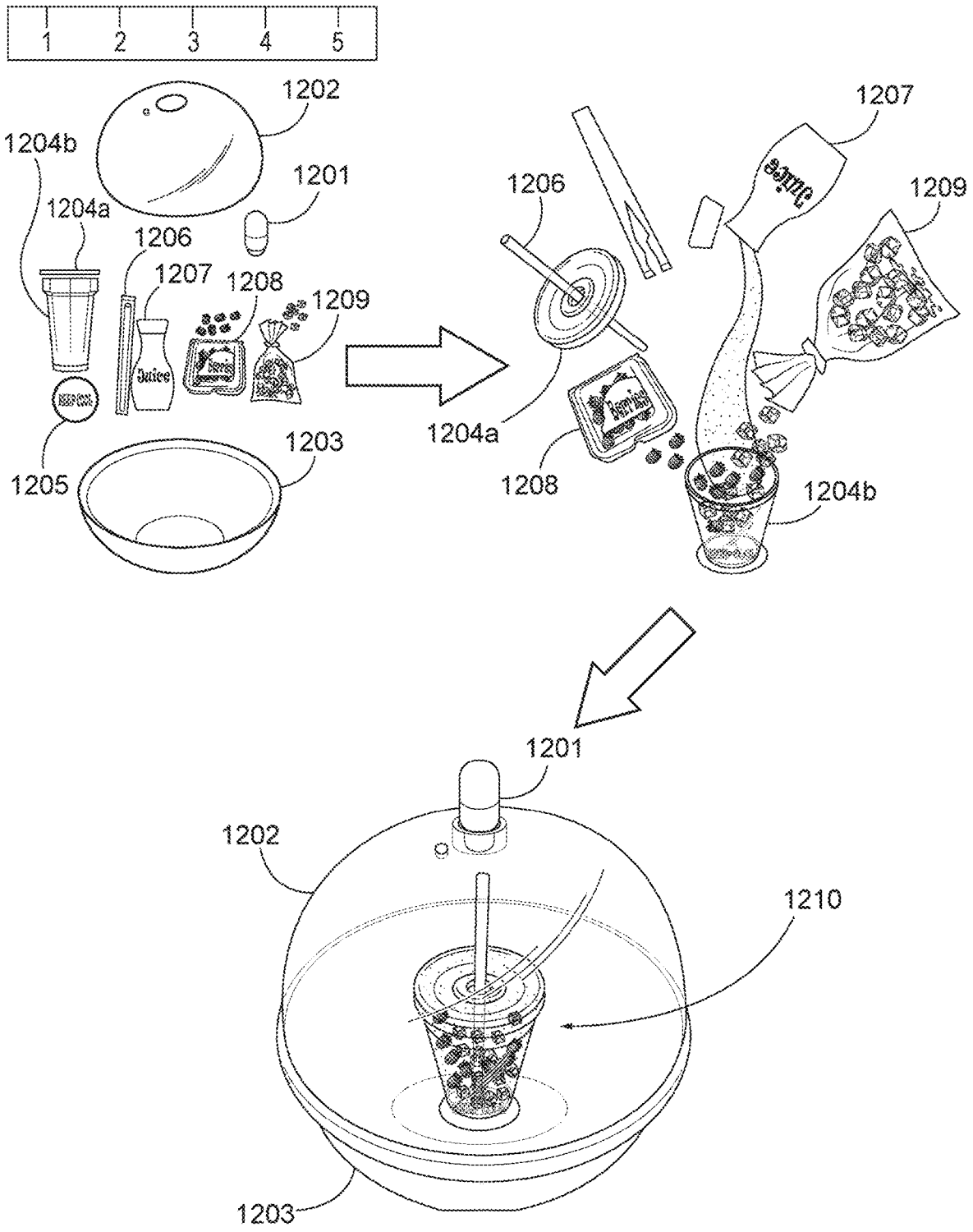
FIG. 12 illustrates an example of a kit for creating miniature replica of a food or beverage item according to an exemplary embodiment.

FIG. 12 illustrates an example of a kit for creating miniature replica of a food or beverage item according to an exemplary embodiment. The kit shown in FIG. 12 is used to create a miniature replica of a berry punch. The kit includes a container top 1202, a container bottom 1203, a handle accessory 1201, a base object comprising a cup 1204B with a lid 1204A, a straw 1206, a placemat 1205, a resin container in the form of a juice box 1207, ingredient objects in the form of berries 1208, which are contained in a miniature replica berry container, and ice cubes 1209 contained in a miniature replica of an ice bag. A ruler in the upper left-hand side of the figure shows the approximate size of the miniature components, in inches. The ingredients (ice cubes 1209 and berries 1208) are added to the base object (the cup 1204B and lid 1204A) along with the resin from the resin container (juice container 1207) and the straw 1206 to create the completed berry punch 1210. Additionally, the handle accessory 1201 is inserted in the container top 1202 (e.g., via a snap-fit mechanism), which, along with the container bottom 1203, serves as a display device for the berry punch 1210.

Figure 13:
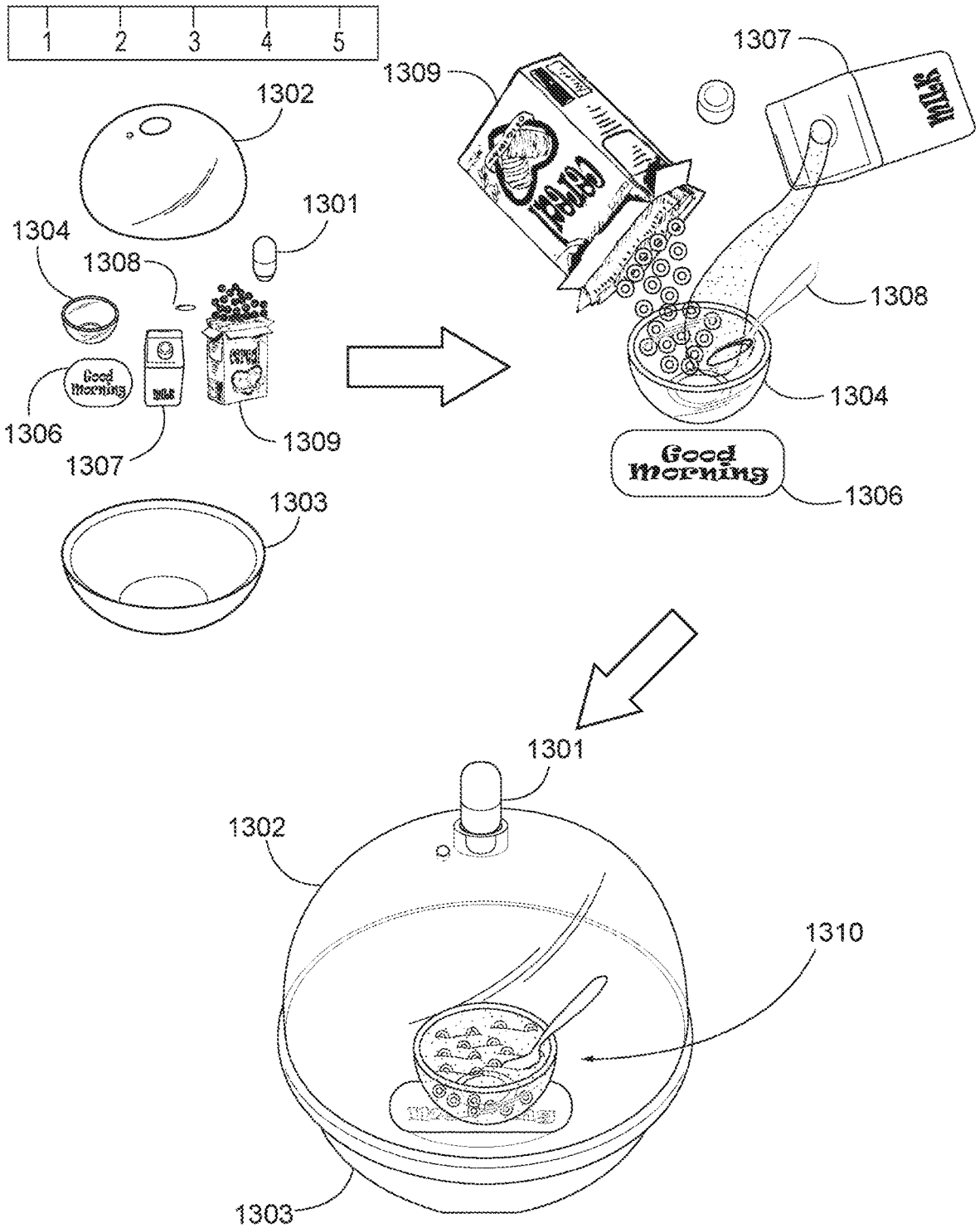
FIG. 13 illustrates another example of a kit for creating miniature replica of a food or beverage item according to an exemplary embodiment.

FIG. 13 illustrates another example of a kit for creating miniature replica of a food or beverage item according to an exemplary embodiment. The kit shown in FIG. 13 is used to create a miniature replica of a bowl of cereal. The kit includes a container top 1302, a container bottom 1303, a handle accessory 1301, a base object comprising a bowl 1304, a spoon 1308, a placemat 1306, a resin container in the form of a milk carton 1307, ingredient objects in the form of cereal 1309, which is contained in a miniature replica cereal container 1309. A ruler in the upper left-hand side of the figure shows the approximate size of the miniature components, in inches. The ingredients (cereal 1309) are added to the base object (the bowl 1304) along with the resin from the resin container (milk carton 1307) and the spoon 1308 to create the completed bowl of cereal 1310. Additionally, the handle accessory 1301 is inserted in the container top 1302 (e.g., via a snap-fit mechanism), which, along with the container bottom 1303, serves as a display device for the bowl of cereal 1310.

Figure 14:
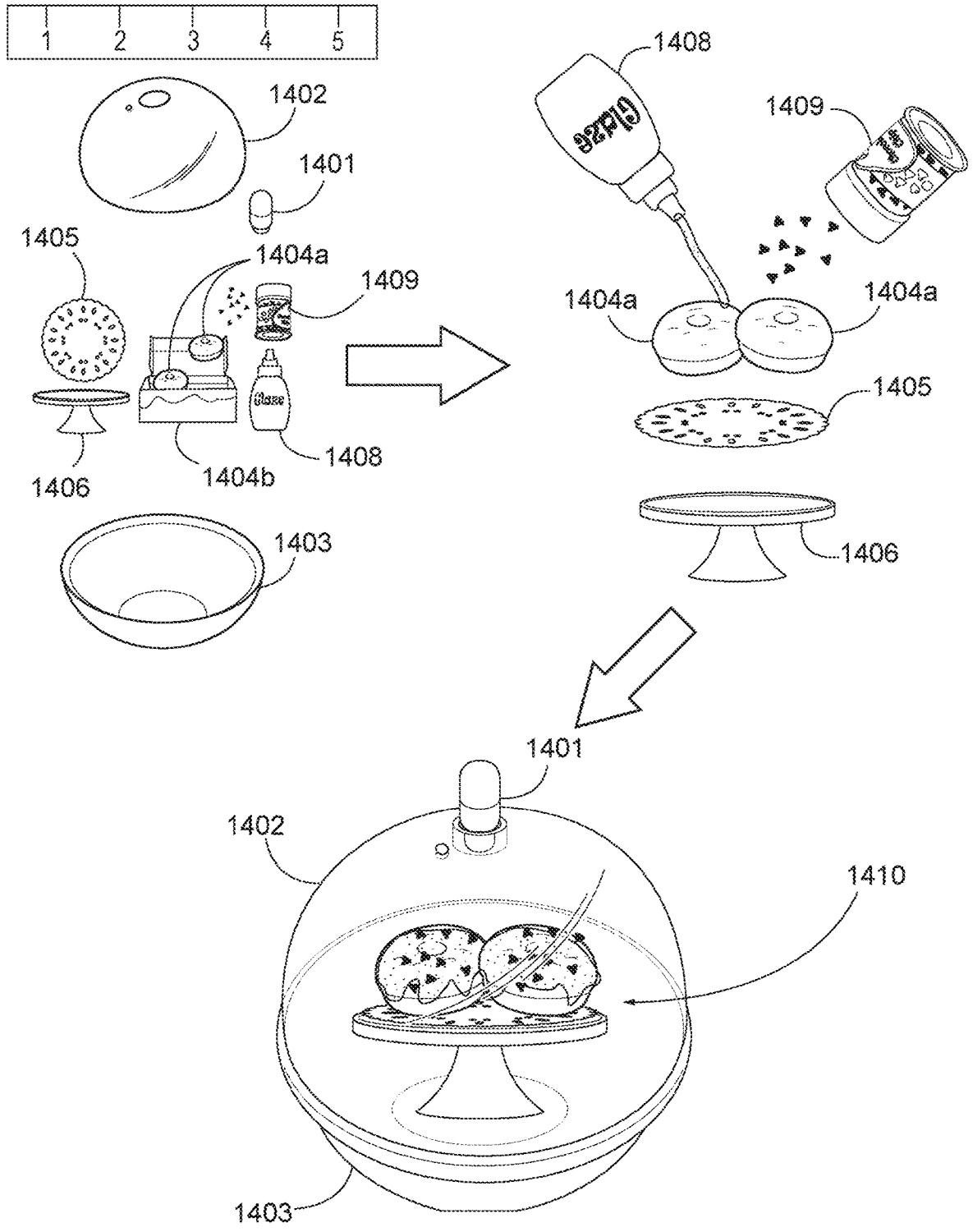
FIG. 14 illustrates another example of a kit for creating miniature replica of a food or beverage item according to an exemplary embodiment.

FIG. 14 illustrates another example of a kit for creating miniature replica of a food or beverage item according to an exemplary embodiment. The kit shown in FIG. 14 is used to create a miniature replica of chocolate glazed donuts. The kit includes a container top 1402, a container bottom 1403, a handle accessory 1401, a base object comprising donuts 1404A contained in a miniature replica donut box 1404B, a placemat 1405, a serving platter 1406, a resin container in the form of a glaze container 1408, ingredient objects in the form of chocolate chips 1409, which are contained in a miniature replica chocolate chip container. A ruler in the upper left-hand side of the figure shows the approximate size of the miniature components, in inches. The ingredients (chocolate chips 1409) are added to the base object (the donuts 1404A) along with the resin from the resin container (glaze container 1408) and placed on the placemat 1405 and serving platter 1406 to create the completed chocolate glazed donuts 1410. Additionally, the handle accessory 1401 is inserted in the container top 1402 (e.g., via a snap-fit mechanism), which, along with the container bottom 1403, serves as a display device for the chocolate glazed donuts 1410.

Figure 15:
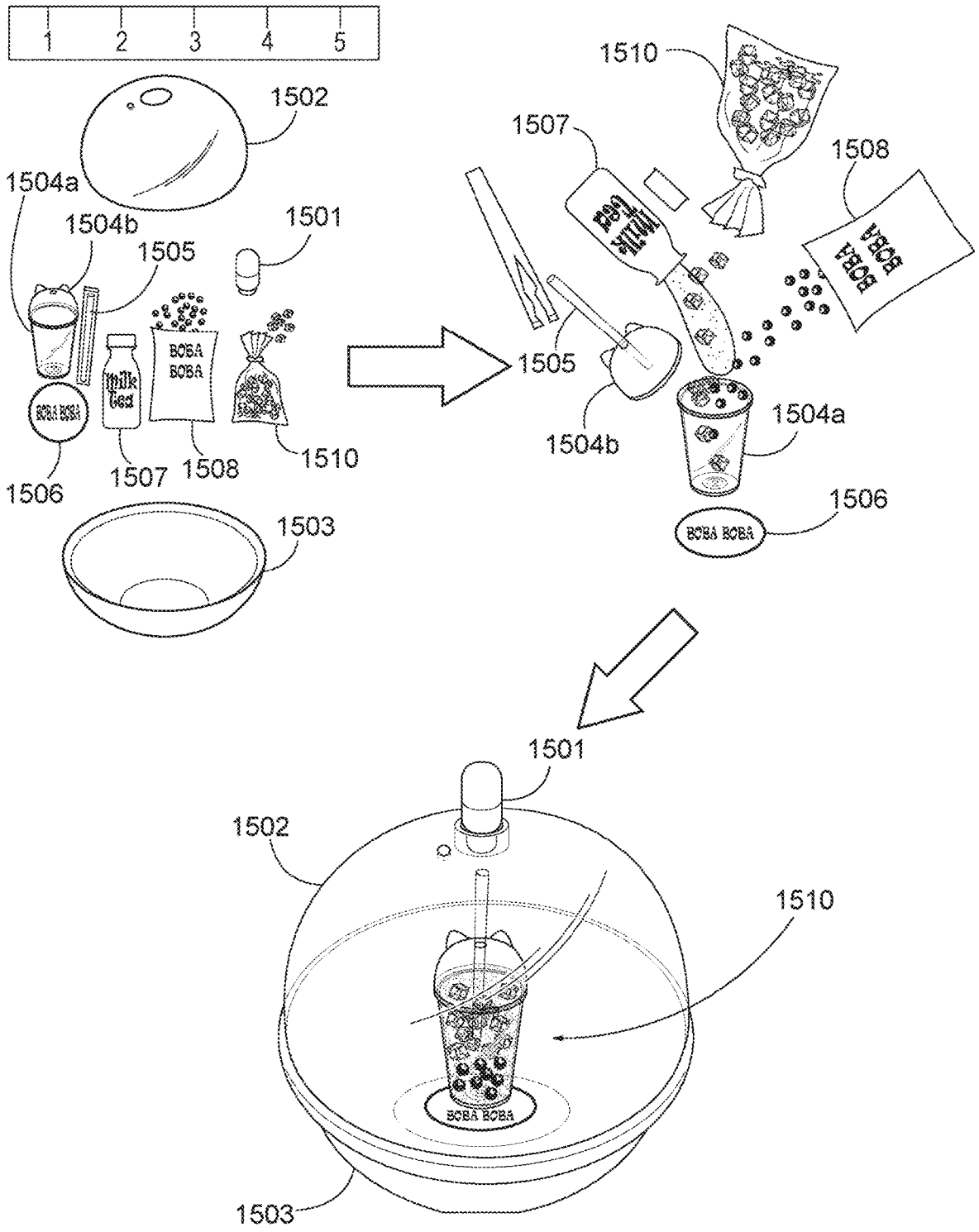
FIG. 15 illustrates another example of a kit for creating miniature replica of a food or beverage item according to an exemplary embodiment.

FIG. 15 illustrates another example of a kit for creating miniature replica of a food or beverage item according to an exemplary embodiment. The kit shown in FIG. 15 is used to create a miniature replica of boba tea. The kit includes a container top 1502, a container bottom 1503, a handle accessory 1501, a base object comprising a cup 1504A with a lid 1504B, a straw 1505, a placemat 1506, a resin container in the form of a milk tea carton 1507, ingredient objects in the form of tapioca bubbles 1508, which are contained in a miniature replica package, and ice cubes 1510, contained in a miniature replica of an ice bag. A ruler in the upper left-hand side of the figure shows the approximate size of the miniature components, in inches. The ingredients (ice cubes 1510 and bubbles 1508) are added to the base object (the cup 1504A and lid 1504B) along with the resin from the resin container (milk tea carton 1507) and the straw 1505 to create the boba tea 1510. Additionally, the handle accessory 1501 is inserted in the container top 1502 (e.g., via a snap-fit mechanism), which, along with the container bottom 1503, serves as a display device for the boba tea 1510.

Figure 16:
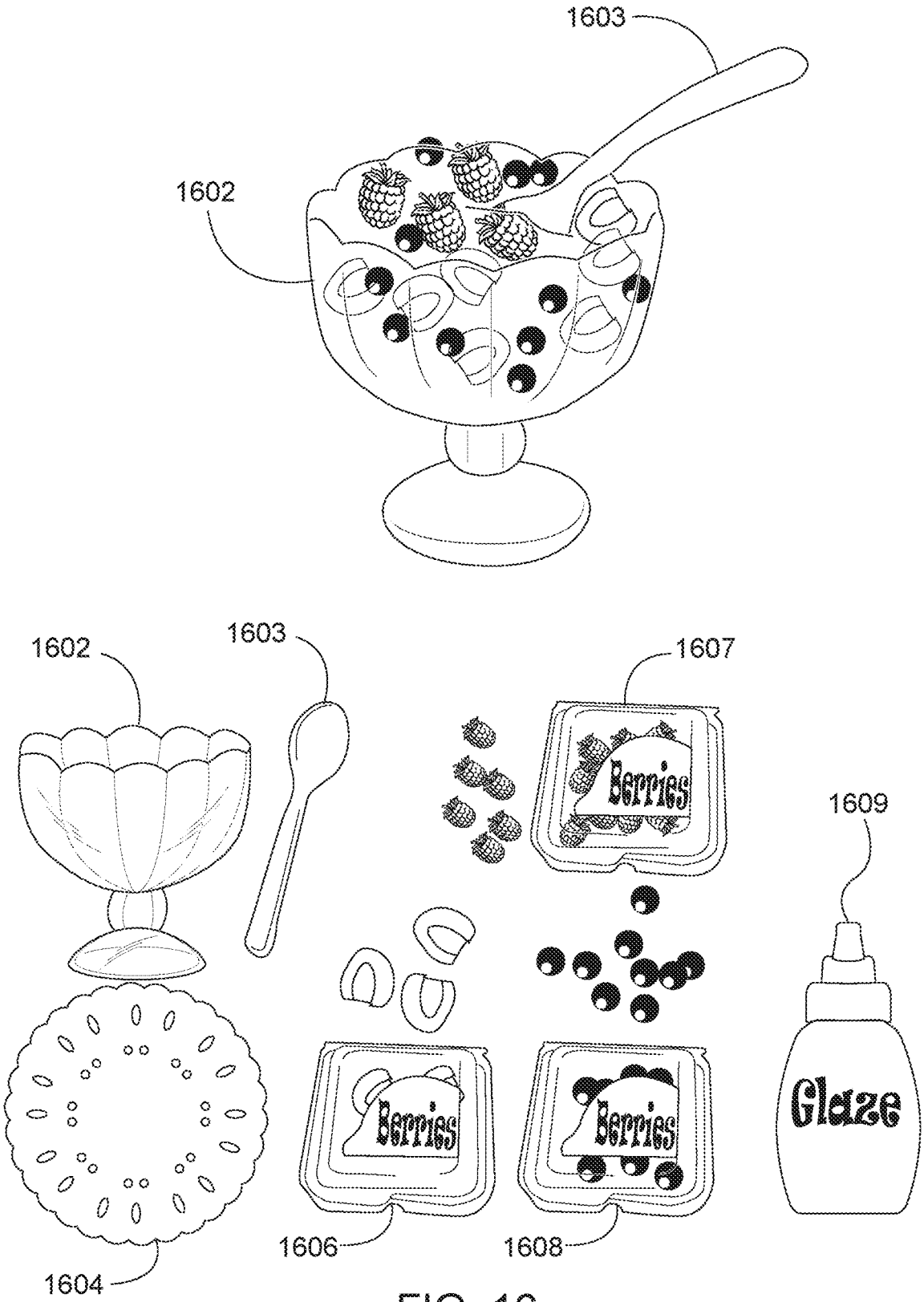
FIG. 16 illustrates another example of a kit for creating miniature replica of a food or beverage item according to an exemplary embodiment.

FIG. 16 illustrates another example of a kit for creating miniature replica of a food or beverage item according to an exemplary embodiment. FIG. 16 omits the container and handle, but illustrates the components used to create a miniature replica of a fruit salad. As shown in FIG. 16, the components include a fruit dish 1602 (base object), different types of berries 1606-1608 (ingredient objects) in replica containers, glaze 1609 (resin) in a glaze container, a placemat 1604 and spoon 1603 (accessory objects).

Figure 17:
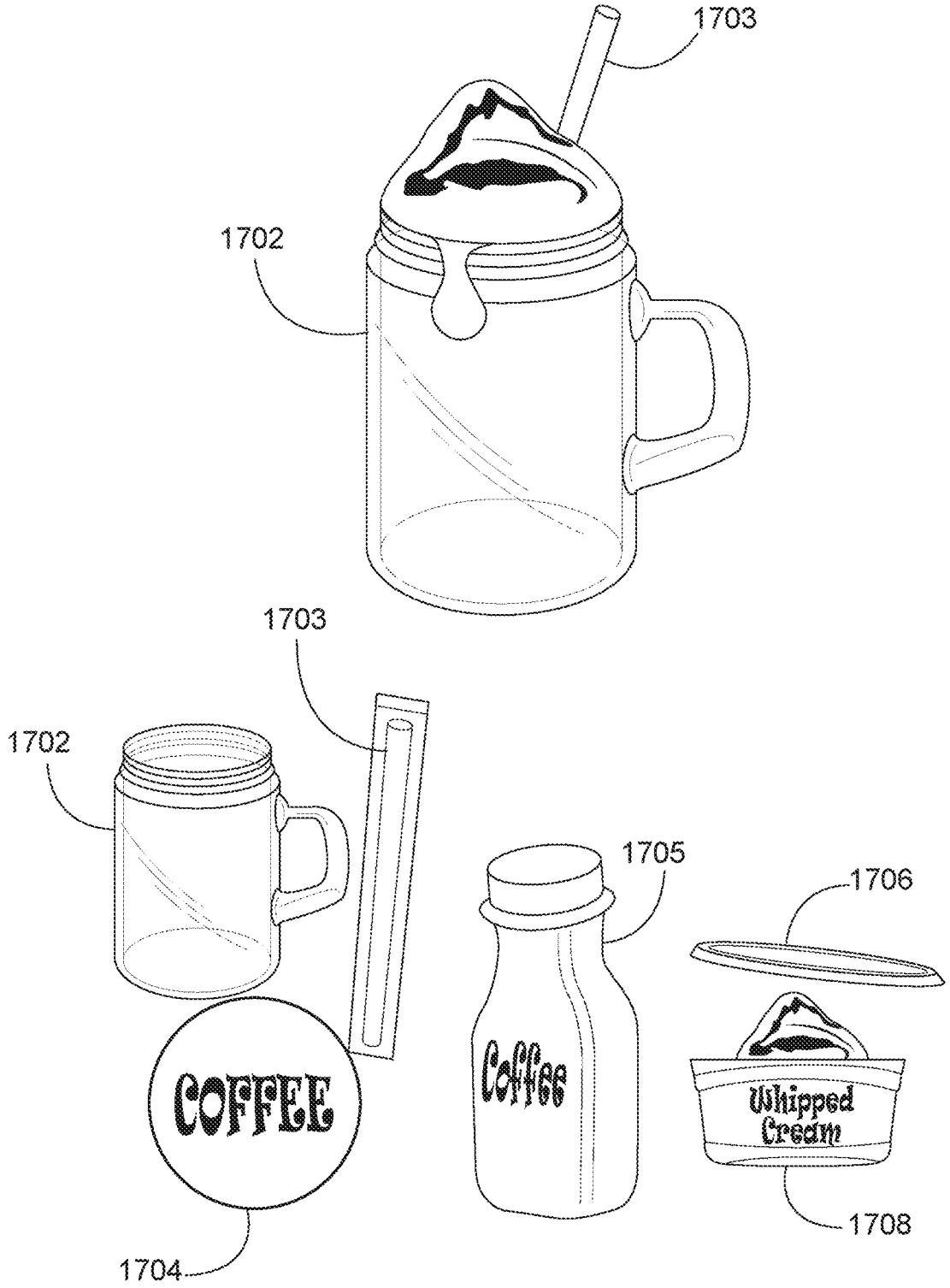
FIG. 17 illustrates another example of a kit for creating miniature replica of a food or beverage item according to an exemplary embodiment.

FIG. 17 illustrates another example of a kit for creating miniature replica of a food or beverage item according to an exemplary embodiment. FIG. 17 omits the container and handle, but illustrates the components used to create a miniature replica of a café latte. As shown in FIG. 17, the components include a drink mug 1702 (base object), whipped cream in a whipped cream container 1708 and lid 1706 (ingredient object), coffee 1705 (resin) in a coffee bottle, a placemat 1704 and straw 1703 (accessory objects).

Figure 18:
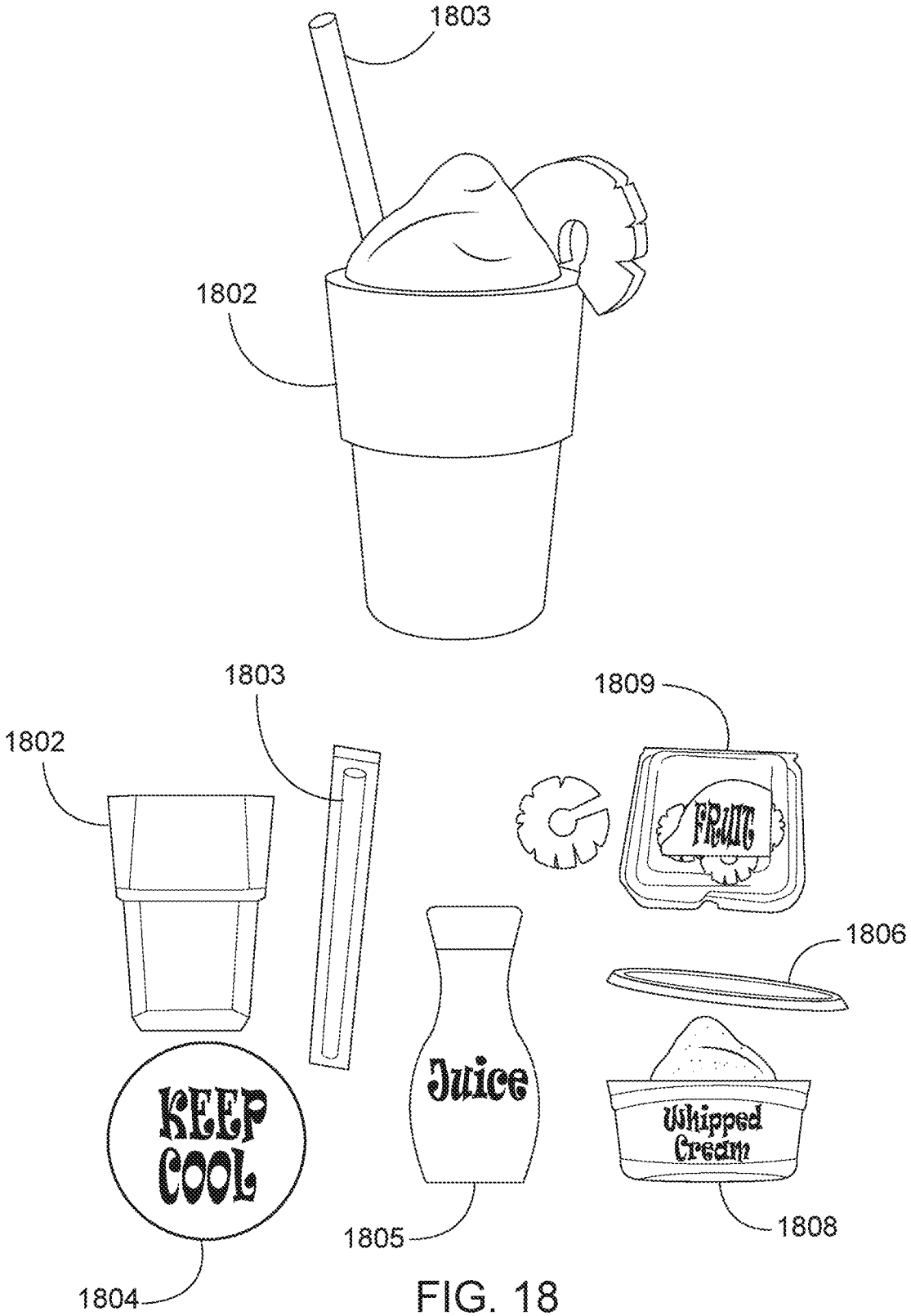
FIG. 18 illustrates another example of a kit for creating miniature replica of a food or beverage item according to an exemplary embodiment.

FIG. 18 illustrates another example of a kit for creating miniature replica of a food or beverage item according to an exemplary embodiment. FIG. 18 omits the container and handle, but illustrates the components used to create a miniature replica of a pineapple smoothie. As shown in FIG. 18, the components include a drink mug 1802 (base object), whipped cream in a whipped cream container 1808 and lid 1806 and pineapple slices 1809 in a fruit container (ingredient object), juice 1805 (resin) in a juice bottle, a placemat 1804 and straw 1803 (accessory objects).

Having described and illustrated the principles of our invention with reference to the described embodiment, it will be recognized that the described embodiment can be modified in arrangement and detail without departing from such principles. Elements of the described embodiment shown in software can be implemented in hardware and vice versa.

In view of the many possible embodiments to which the principles of our invention can be applied, we claim as our invention all such embodiments as can come within the scope and spirit of the following claims and equivalents thereto.

What is claimed is:

1. A miniature replica kit of a food serving, comprising:
- a shipping container separable into two portions and when the two portions are closed together define an interior volume;
- wherein the shipping container is configured to and does contain a plurality of miniature replica items during shipping within the interior volume of the shipping container;
- wherein the plurality of miniature replica items are associated with the food serving;
- wherein the plurality of miniature replica items includes at least one non-curable element and at least one curable element;
- wherein the plurality of miniature replica items comprise:
  - at least one miniature replica serving container;
  - at least one curable resin contained within a resin container configured to be placed on or within the at least one miniature serving container,
  - wherein the at least one curable resin is a miniature replica food item; and
  - at least one miniature replica ingredient item;
- wherein the at least one curable resin is configured to be dispensed and attach together the at least one miniature replica serving container and the at least one miniature replica ingredient item forming a cured composite miniature replica food serving.

2. The miniature replica kit of claim 1, wherein the at least one non-curable item comprises: the at least one miniature replica serving container and the at least one miniature replica ingredient item.

3. The miniature replica kit of claim 2, wherein the at least one curable element comprises the at least one curable resin.

4. The miniature replica kit of claim 3, wherein the at least one curable resin is configured to be dispensed from the resin container and thereafter solidify attaching the at least one miniature replica ingredient item and the at least one miniature replica serving container.

5. The miniature replica kit of claim 4, wherein the at least one curable resin is a UV-curable viscous resin.

6. The miniature replica kit of claim 1, wherein the at least one miniature replica serving container is a bowl or a cup.

7. The miniature replica kit of claim 1, wherein the at least one miniature replica serving container is clear or translucent allowing light to pass therethrough.

8. The miniature replica kit of claim 7, wherein the at least one curable resin is opaque and the resin container comprises a miniature replica of a container associated with the food serving.

9. The miniature replica kit of claim 1, including at least one miniature replica placemat.

10. The miniature replica kit of claim 1, wherein the at least one miniature replica ingredient item is separately packaged within a miniature replica ingredient item container.

11. The miniature replica kit of claim 10, wherein the miniature replica ingredient item container is at least partially clear configured to view the at least one miniature replica ingredient item disposed within.

12. The miniature replica kit of claim 10, wherein the miniature replica ingredient item container is openable configured to allow removal of the at least one miniature replica ingredient item disposed within.

13. The miniature replica kit of claim 1, including a miniature replica tong, a miniature replica spoon, a miniature replica knife and/or a miniature replica fork.

14. A miniature replica kit of a food serving, comprising:
- a ball-shaped shipping container separable into two semi-spherical portions and when the two portions are closed together define an interior volume;
- wherein the ball-shaped shipping container is configured to and does contain a plurality of miniature replica items during shipping within the interior volume of the ball-shaped shipping container;
- wherein the plurality of miniature replica items are associated with the food serving;
- wherein the plurality of miniature replica items includes at least one non-curable element and at least one curable element;
- wherein the plurality of miniature replica items comprise:
  - at least one miniature replica serving container;
  - wherein the at least one miniature replica serving container is a bowl or a cup;
  - at least one curable resin contained within a resin container and configured to be placed on or within the at least one miniature serving container, wherein the at least one curable resin is a miniature replica food item;
  - at least one miniature replica ingredient item;
  - wherein the at least one miniature replica ingredient item is separately packaged within a miniature replica ingredient item container; and
  - at least one miniature replica placemat;
- wherein the at least one non-curable item comprises the at least one miniature replica serving container and the at least one miniature replica ingredient item;
- wherein the at least one curable element comprises the at least one curable resin; and
- wherein the at least one curable resin is configured to be dispensed from the resin container and thereafter solidify attaching the at least one miniature replica ingredient item and the at least one miniature replica serving container forming a cured composite miniature replica food serving.

15. A miniature replica kit of a food serving comprising a plurality of miniature replica items including at least one non-curable element and at least one curable element; wherein the plurality of miniature replica items comprises:
- at least one miniature replica serving container;
- wherein the at least one miniature replica serving container is a bowl or a cup;

at least one curable resin contained within a resin container configured to be placed on or within the at least one miniature serving container, wherein the at least one curable resin is a miniature replica food item;

at least one miniature replica ingredient item;

wherein the at least one miniature replica ingredient item is separately packaged within a miniature replica ingredient item container; and at least one miniature replica placemat;

wherein the at least one non-curable item comprises the at least one miniature replica serving container and the at least one miniature replica ingredient item;

wherein the at least one curable element comprises the at least one curable resin; and wherein the at least one curable resin is configured to be dispensed from the resin container and thereafter solidify attaching the at least one miniature replica ingredient item and the at least one miniature replica serving container forming a cured composite miniature replica food serving.

16. The miniature replica kit of claim 15, including a shipping container separable into two portions and when the two portions are closed together define an interior volume, wherein the shipping container is configured to contain the plurality of miniature replica items during shipping within the interior volume of the shipping container.

* * * * *